US008602235B2

(12) United States Patent
Meager

(10) Patent No.: US 8,602,235 B2
(45) Date of Patent: Dec. 10, 2013

(54) PRESSURE EQUALIZATION APPARATUS FOR A BOTTLE AND METHODS ASSOCIATED THEREWITH

(75) Inventor: Benjamin Meager, Bozeman, MT (US)

(73) Assignee: Paha Designs, LLC, Denver, CO (US)

( * ) Notice: Subject to any disclaimer, the term of this patent is extended or adjusted under 35 U.S.C. 154(b) by 261 days.

(21) Appl. No.: 13/019,941

(22) Filed: Feb. 2, 2011

(65) Prior Publication Data

US 2011/0186535 A1 Aug. 4, 2011

Related U.S. Application Data

(60) Provisional application No. 61/301,133, filed on Feb. 3, 2010, provisional application No. 61/319,030, filed on Mar. 30, 2010.

(51) Int. Cl.
*B65D 51/16* (2006.01)
*B65D 1/02* (2006.01)
*B65D 25/38* (2006.01)

(52) U.S. Cl.
USPC ..... 215/309; 215/307; 215/386; 215/40; 220/694; 220/731

(58) Field of Classification Search
USPC ..... 215/40, 386, 307, 309; 220/694
See application file for complete search history.

(56) References Cited

U.S. PATENT DOCUMENTS 2,796,205 A 6/1957 Kuzma
2,812,113 A * 11/1957 Beall, Jr. ..... 222/111
2,835,403 A 5/1958 Scheminger, Jr.
3,168,221 A 2/1965 Parker
3,506,167 A 4/1970 Orr
3,655,102 A 4/1972 Moran
3,834,594 A 9/1974 Schiemann
3,944,104 A 3/1976 Watson et al.
3,966,099 A 6/1976 Sanford, Jr. et al.
4,452,381 A 6/1984 Freeman
4,597,513 A 7/1986 Schiemann (Continued)

FOREIGN PATENT DOCUMENTS

DE 19652216 A1 8/1997

OTHER PUBLICATIONS

International Search Report and Written Opinion for International (PCT) Patent Application No. PCT/US12/36430, mailed Jul. 26, 2012 9 pages.

(Continued)

*Primary Examiner* — Anthony Stashick
*Assistant Examiner* — Jennifer Castriotta
(74) *Attorney, Agent, or Firm* — Sheridan Ross P.C.

(57) ABSTRACT

A device that assists with equalizing air pressure within a bottle with the atmospheric air pressure as liquid is being poured from the bottle and includes one or more relatively short air tubes. The air tubes are situated with an upper inlet rim of the air tubes located flush with or relatively near the bottle rim. Whether an insert or integrated into the manufacture of a container, the one or more air tubes that extend partially into the container allow air to pass into the container as the liquid exits the container. The pressure equalizer not only minimizes or prevents the common glugging effect, but it allows liquid from a bottle to be poured smoothly at any angle and orientation. A cap incorporating a detachable pressure equalizer is also described.

13 Claims, 26 Drawing Sheets

(56) References Cited

U.S. PATENT DOCUMENTS

| | | | | |
|---|---|---|---|---|
| 4,793,514 | A | 12/1988 | Sheets | |
| 4,838,464 | A | 6/1989 | Briggs | |
| 4,886,194 | A | 12/1989 | Schiemann | |
| 4,911,315 | A | 3/1990 | Shrum | |
| 5,002,209 | A | 3/1991 | Goodall | |
| 5,104,010 | A | 4/1992 | Codorniz et al. | |
| 5,133,482 | A | 7/1992 | Burrows et al. | |
| 5,134,875 | A | 8/1992 | Jensen et al. | |
| 5,228,603 | A | 7/1993 | Pham et al. | |
| 5,232,110 | A | 8/1993 | Purnell | |
| 5,340,000 | A | 8/1994 | Ring | |
| 5,346,097 | A | 9/1994 | Melland et al. | |
| 5,392,947 | A * | 2/1995 | Gentile | 220/665 |
| 5,392,957 | A | 2/1995 | Parsons | |
| 5,474,112 | A | 12/1995 | Carola | |
| 5,538,165 | A | 7/1996 | Frohn | |
| 5,605,254 | A | 2/1997 | Wagner, III et al. | |
| 5,839,625 | A | 11/1998 | Braginetz | |
| 6,138,877 | A | 10/2000 | Goff | |
| 6,170,719 | B1 | 1/2001 | Wilkinson et al. | |
| 6,196,425 | B1 | 3/2001 | Fielding et al. | |
| 6,439,433 | B1 | 8/2002 | Dubach et al. | |
| 6,460,741 | B1 | 10/2002 | Ho | |
| 6,478,058 | B1 | 11/2002 | Pears | |
| 6,644,471 | B1 | 11/2003 | Anderson | |
| 6,845,885 | B2 | 1/2005 | Morgenroth | |
| 7,395,949 | B2 | 7/2008 | Ehret et al. | |
| 7,441,677 | B2 * | 10/2008 | Garcia | 222/481.5 |
| 7,464,834 | B2 | 12/2008 | Law et al. | |
| 7,543,723 | B2 | 6/2009 | Wilford et al. | |
| 8,016,146 | B2 | 9/2011 | Rekstad | |
| 2002/0003154 | A1 | 1/2002 | Soehnlen et al. | |
| 2004/0026466 | A1 | 2/2004 | Lehner et al. | |
| 2004/0035894 | A1 | 2/2004 | Gobbini et al. | |
| 2005/0040130 | A1 * | 2/2005 | Bivens | 215/40 |
| 2006/0081662 | A1 | 4/2006 | Miura | |
| 2007/0108156 | A1 | 5/2007 | Durand et al. | |
| 2007/0199953 | A1 | 8/2007 | Laveault et al. | |
| 2007/0284399 | A1 | 12/2007 | Baughman et al. | |
| 2008/0078765 | A1 | 4/2008 | Steiger et al. | |
| 2008/0099514 | A1 | 5/2008 | Carter et al. | |
| 2008/0110849 | A1 | 5/2008 | Wachsberg | |
| 2009/0159620 | A1 | 6/2009 | Nielsen | |
| 2009/0212079 | A1 | 8/2009 | Baughman et al. | |
| 2011/0210092 | A1 | 9/2011 | Meager | |
| 2012/0193318 | A1 | 8/2012 | Meager | |

OTHER PUBLICATIONS

International Search Report for PCT/US2011/023511, mailed Mar. 25, 2011, 3 pages.

Written Opinion for PCT/US2011/023511, mailed Mar. 25, 2011, 8 pages.

Official Action for U.S. Appl. No. 13/101,907, mailed Jan. 31, 2013 5 pages Restriction Requirement.

Official Action for U.S. Appl. No. 13/101,907, mailed Mar. 26, 2013 5 pages Restriction Requirement.

Official Action for U.S. Appl. No. 13/358,390, mailed Apr. 3, 2013 5 pages Restriction Requirement.

Official Action for U.S. Appl. No. 13/101,907, mailed Jul. 1, 2013 9 pages.

Official Action for U.S. Appl. No. 13/358,390, mailed Jul. 26, 2013 8 pages.

* cited by examiner

Figure 10
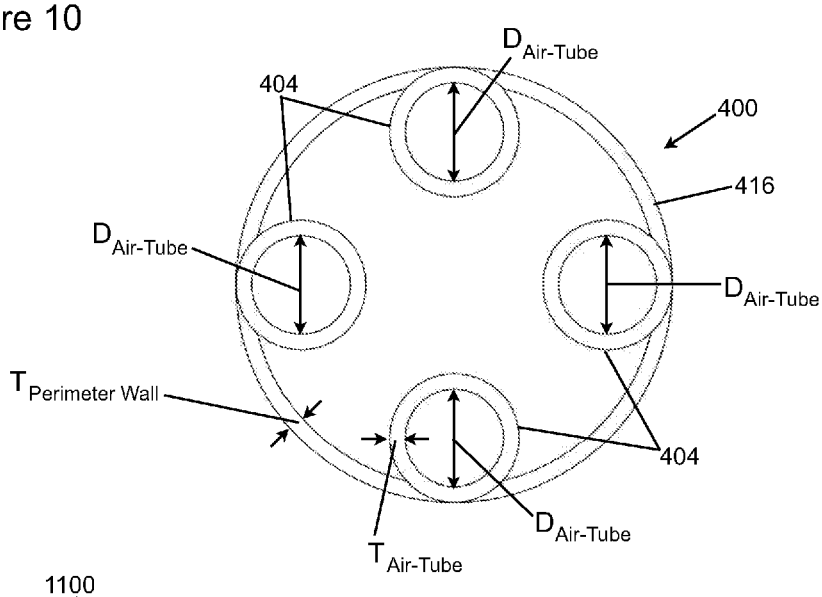
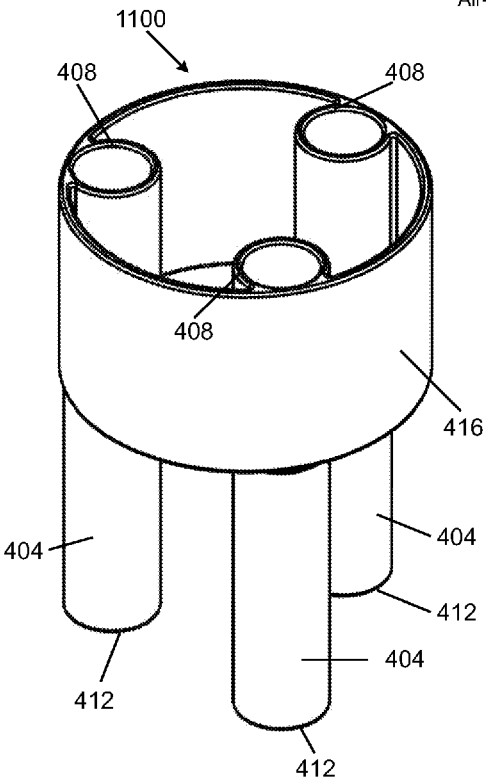
Figure 11
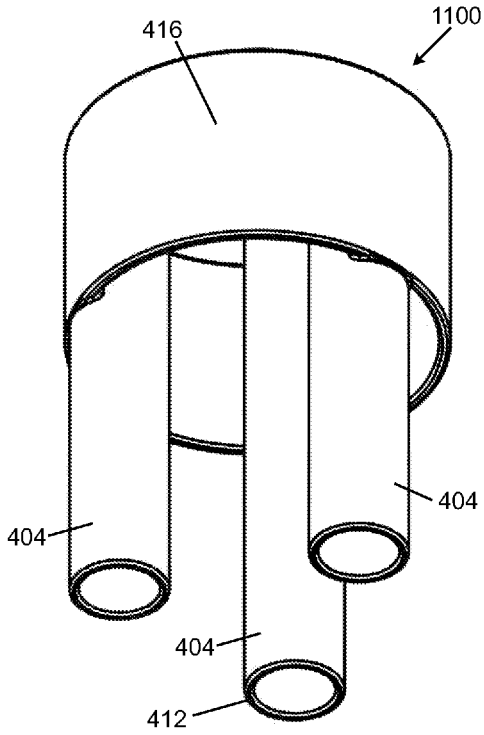
Figure 12

Figure 13
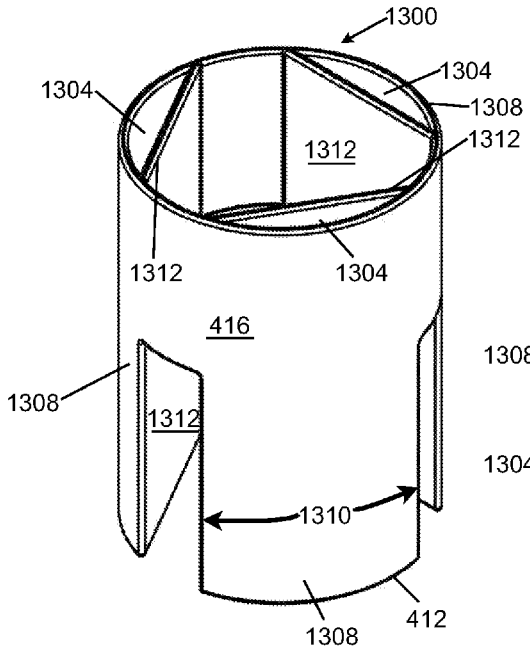
Figure 14
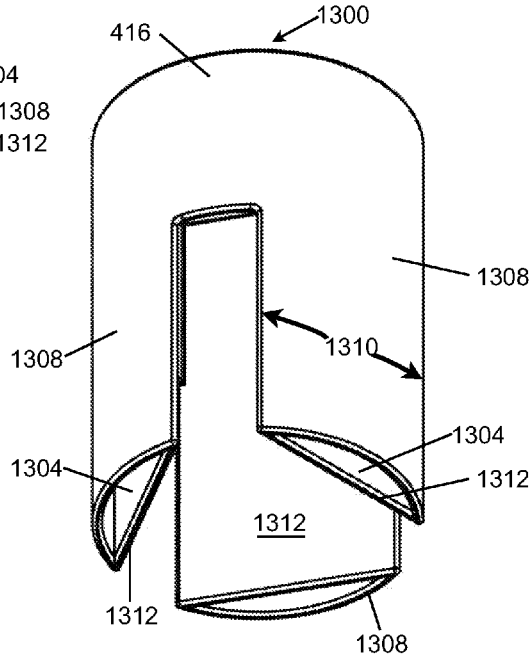
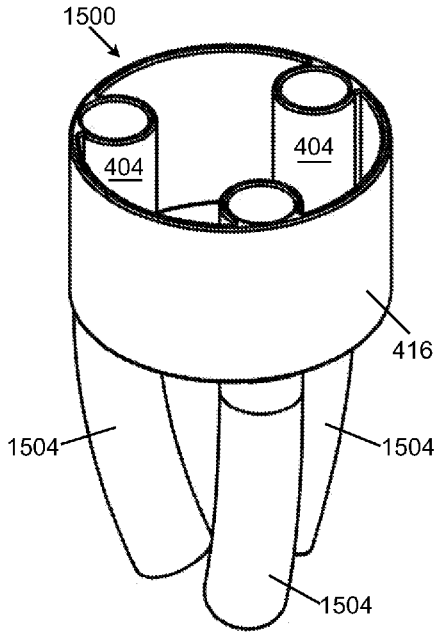
Figure 15
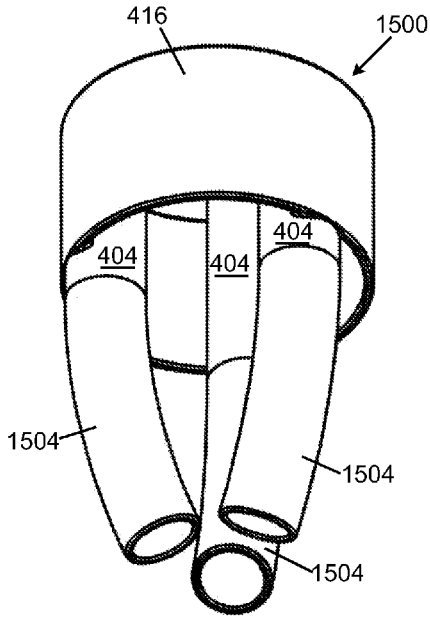
Figure 16

Figure 18
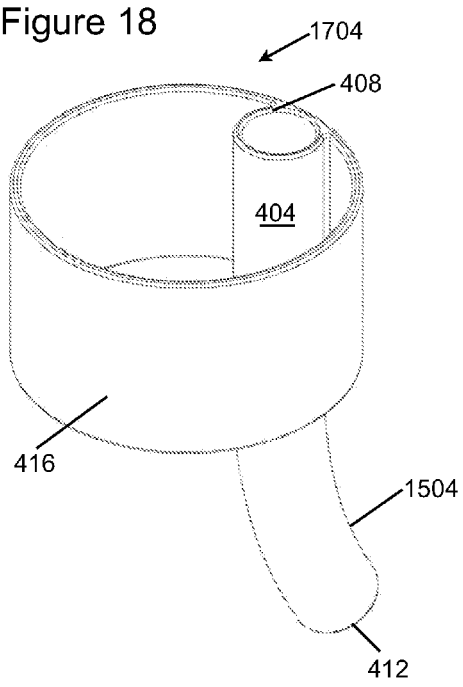
Figure 19
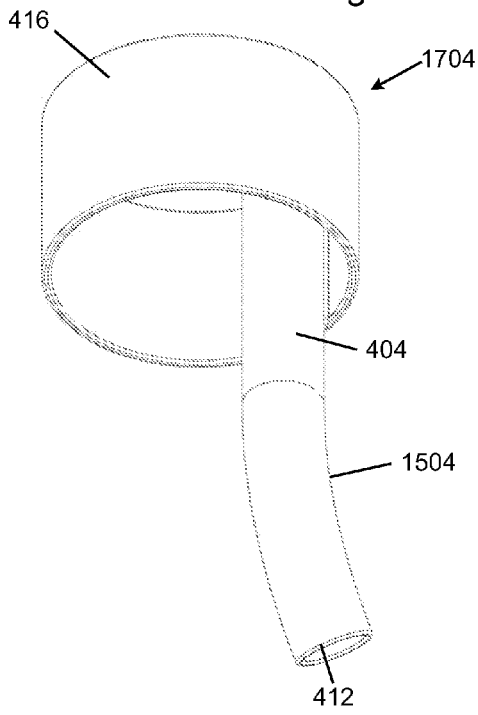
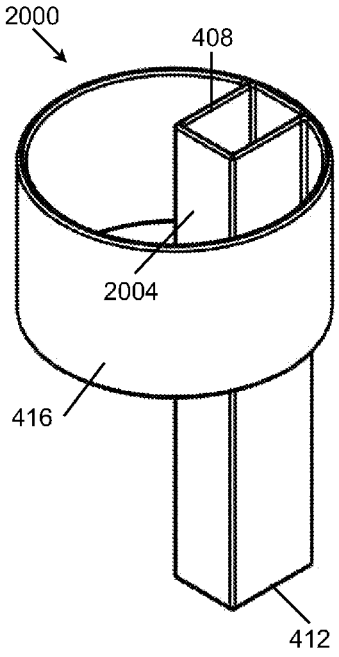
Figure 20
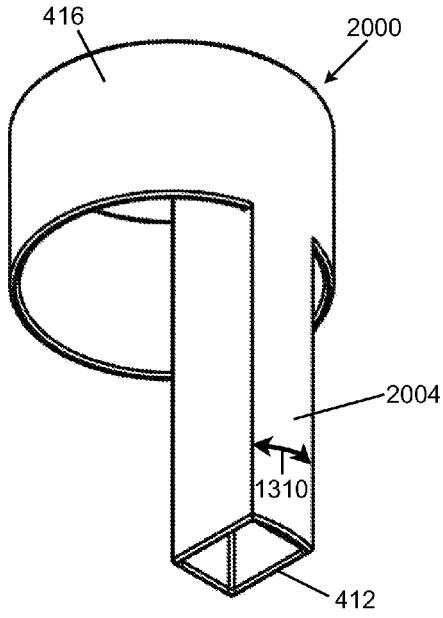
Figure 21

Figure 22
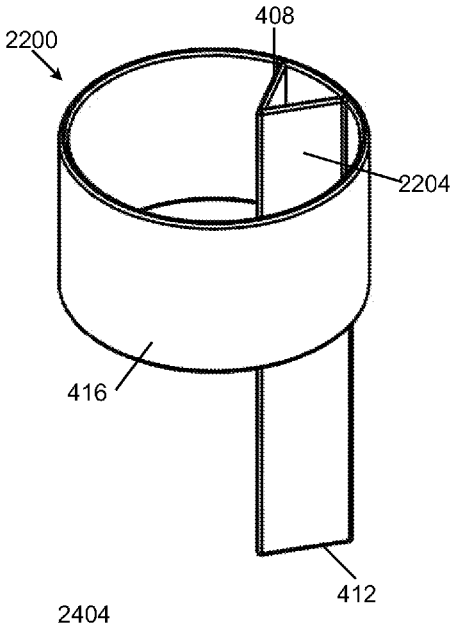
Figure 23
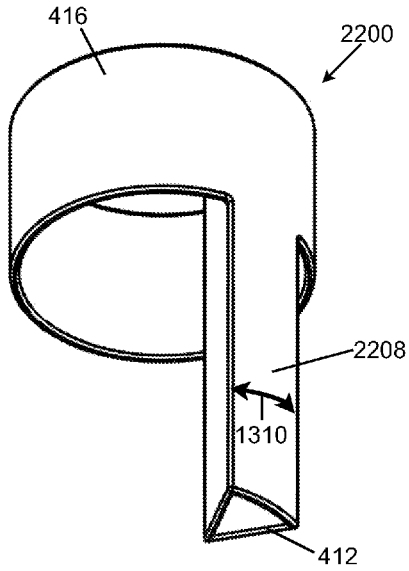
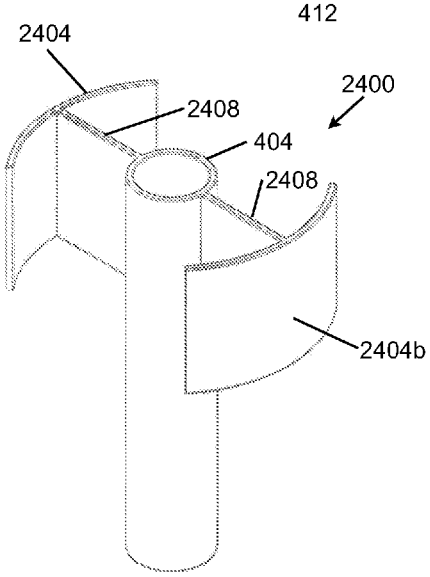
Figure 24
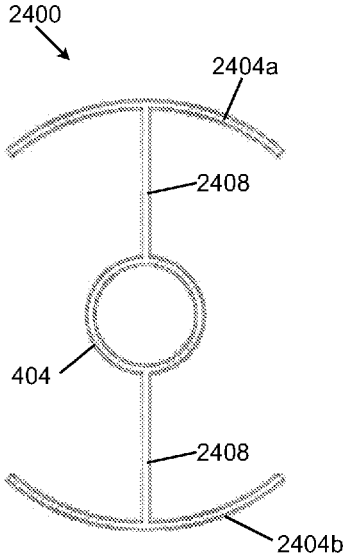
Figure 25

Figure 32
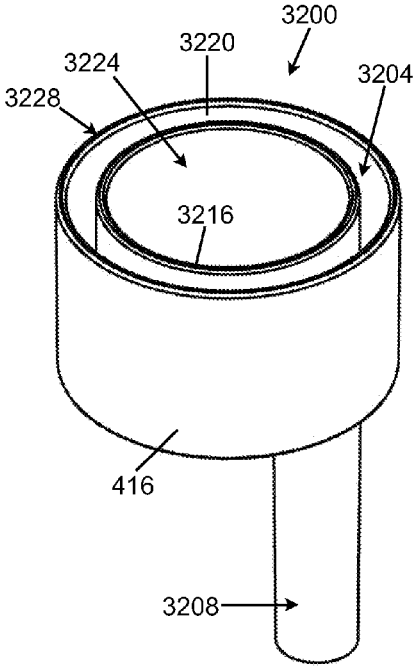
Figure 33
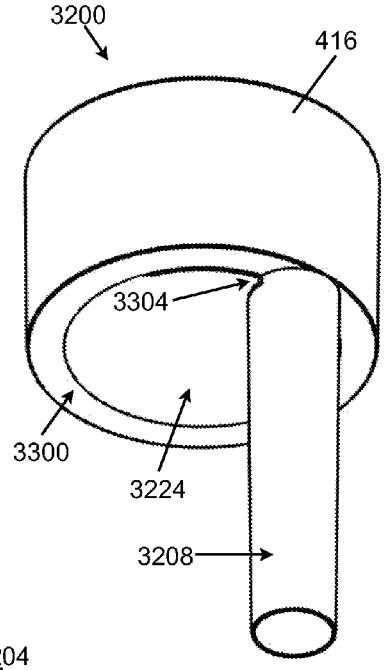
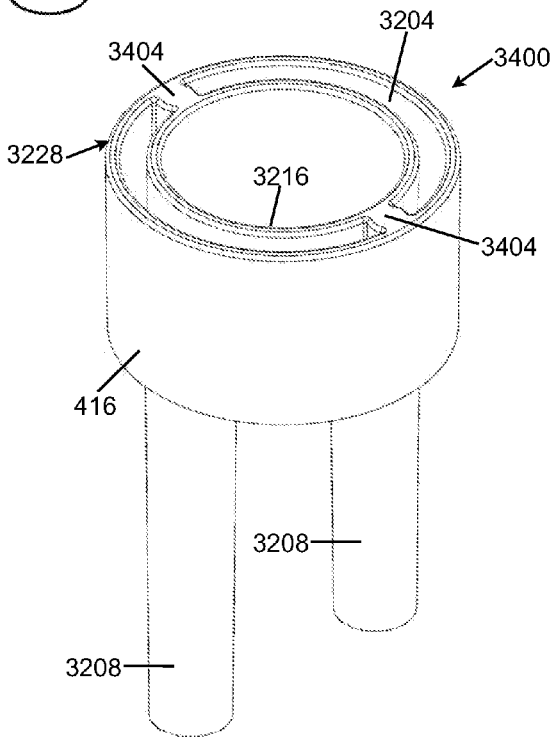
Figure 34

Figure 35
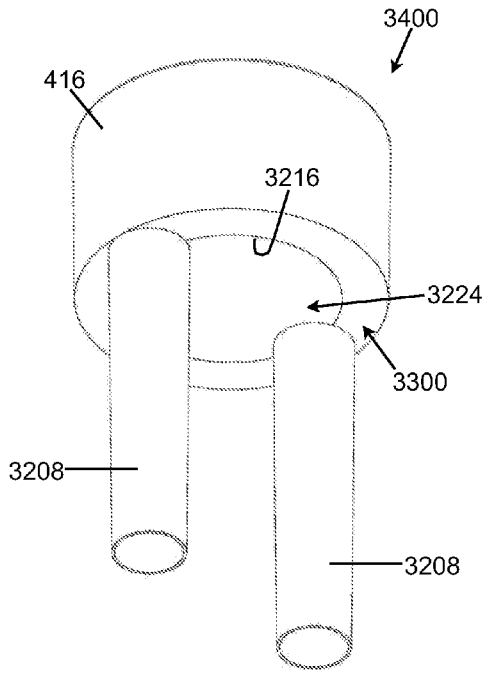
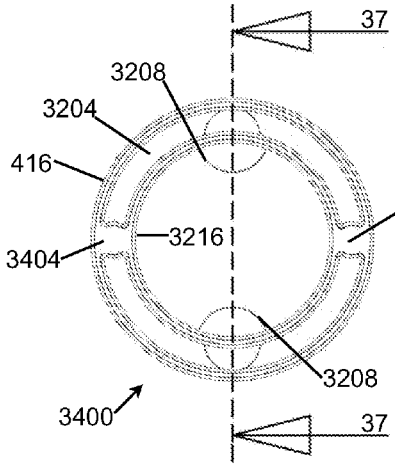
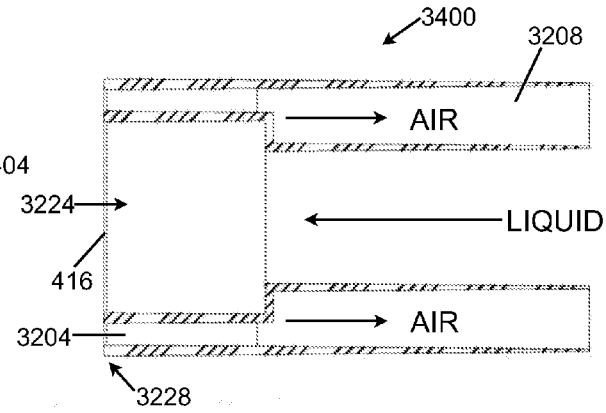
Figure 36
Figure 37

PRESSURE EQUALIZATION APPARATUS FOR A BOTTLE AND METHODS ASSOCIATED THEREWITH

CROSS-REFERENCE TO RELATED APPLICATIONS

The present application claims the benefit of U.S. Provisional Patent Application No. 61/301,133 filed on Feb. 3, 2010 and U.S. Provisional Patent Application No. 61/319,030 filed on Mar. 30, 2010; the contents of the foregoing applications are incorporated herein by reference in their entirety.

FIELD

Embodiments of the one or more present inventions are related to a device that assists with equalizing air pressure within a bottle with the atmospheric air pressure, as liquid is being poured from the bottle.

BACKGROUND

A person pouring liquid from a bottle is often faced with the liquid pouring erratically and even splashing due to "glugging" (that is, uneven flow during pouring) caused by unbalanced pressures between the atmospheric air pressure outside the bottle and the air pressure within the bottle. Referring now to FIG. 1, a bottle 100 is shown in a cross-sectional view, wherein the cross-sectional alignment is taken along line 1-1 of the top elevation view of the bottle 100 depicted in FIG. 2. The bottle 100 includes a bottle wall 104 having an exterior surface 108. The bottle wall 104 includes a base 112 and extends from the base 112 to the top 116 of the bottle 100. The top 116 of the bottle 100 further includes a bottle opening 120 that leads to the bottle interior 124. The bottle interior 124 is defined by an interior surface 128 of the bottle wall 104. The bottle 100 has a bottle length $B_L$, wherein the bottle length $B_L$ is defined herein as the height of the bottle interior 124; that is, the distance between the interior surface 128 of the bottle wall 104 at the deepest portion of the base 112 of the bottle 100 and a top edge 132 of the bottle rim 136 at the top 116.

Referring now to FIG. 3, an enlarged cross-sectional view of an upper portion 140 of the bottle 100 is shown. As those skilled in the art will appreciate, a variety of sealing mechanisms may be used to seal a bottle. By way of example, a threaded cap may be used to seal the bottle. Such a configuration is illustrated in FIG. 3, wherein a threaded cap 148 is depicted directly above the bottle 100. The upper portion 140 of the bottle 100 includes a bottleneck 152. Threads 156 along the exterior surface 108 of the bottleneck 152 are configured to engage threads within cap 148.

Still referring to FIG. 3, the bottleneck 152 includes a substantially constant bottleneck diameter $D_{Bottleneck}$. The bottleneck 152 itself extends from the bottle rim 136 to a location where the bottle 100 begins its taper outward. That is, where the diameter of the bottle 100 increases from the bottleneck diameter $D_{Bottleneck}$. Accordingly, the bottleneck 152 has a bottleneck length $L_{Bottleneck}$ that is defined as the distance between the bottle rim 136 and the bottleneck base 160, which is the location where the bottleneck diameter $D_{Bottleneck}$ no longer remains substantially constant.

Prior devices for attempting to provide for smooth fluid pouring have performance issues, require significant materials, and/or have other limitations, such as extending above the bottle top, thereby complicating or even preventing recapping/resealing of the bottle. Accordingly, there is a need for other devices to address the glugging problem associated with pouring liquids from a bottle.

SUMMARY

It is to be understood that the present invention includes a variety of different versions or embodiments, and this Summary is not meant to be limiting or all-inclusive. This Summary provides some general descriptions of some of the embodiments, but may also include some more specific descriptions of other embodiments.

One or more embodiments of the one or more present inventions are directed to a device that assists with equalizing air pressure within a bottle with the atmospheric air pressure, as liquid is being poured from the bottle. Various embodiments of the pressure equalizers described herein can accommodate various bottle shapes, bottle sizes, liquids, and pouring angles. By way of example, the pressure equalizers are suitable for beverages, chemicals, solutions, suspensions, mixtures, and other liquids. In its most basic form, the pressure equalizer comprises two main fluid flow paths: (a) a channel that allows liquid to pass out of the bottle; and (b) one or more air tubes or air ducts to allow air to enter the bottle.

At least one embodiment of the one or more present inventions described herein utilizes one or more relatively short air tubes, as compared to the bottle length. The air tubes function by pressure differential and are not required to be in contact with an air cavity at the bottom of the bottle of liquid. In at least one embodiment, the pressure equalizer comprises at least one air tube with an air tube rim located substantially flush with the top of the bottle, or at least within 5% of the bottle rim relative to the length of the bottleneck. Unlike an insert used for alcohol bottles at a bar where the insert appears to be meant to slow the flow of liquid, embodiments described herein increase the flow of liquid and better facilitate air/gas entry into the bottle. More particularly, the pressure equalizers described herein mitigate or prevent the glugging effect that occurs when liquid is attempting to exit a bottle at the same time that air is attempting to enter the bottle. At least some embodiments of the pressure equalizers can be incorporated directly into a current bottle mold design, a new bottle mold, or as an inserted device. The device, regardless of how it is incorporated into a bottle, involves one or more air tubes that extend partially into the bottle and allow air to pass into the bottle as the liquid exits the bottle. This device not only minimizes or prevents the common glugging effect, but it can allow liquid from a bottle to be poured smoothly at any angle.

Accordingly, a bottle insert for substantially equalizing atmospheric air pressure with air pressure within a bottle when pouring a liquid from the bottle is provided, the bottle having a bottle length $B_L$, the bottle including a bottleneck and a bottle opening having an opening diameter, the bottleneck having an interior bottleneck wall and a bottleneck length $L_{Bottleneck}$ extending between a bottle opening rim at the bottle opening to a bottleneck base at a top of a bottle taper of the bottle, the bottle opening rim circumscribing the bottle opening, the bottle insert comprising:

- a perimeter member adapted for contacting at least a portion of the interior bottleneck wall; and
- an air tube attached to the perimeter member, the air tube including an upper inlet rim and a lower end edge, the air tube including an air tube length $L_{Air\ Tube}$ extending between the upper inlet rim and the lower end edge, wherein the upper inlet rim is configured for positioning within a rim proximity distance of about 0% to 5% of the bottleneck length $L_{Bottleneck}$ above or below the bottle opening rim, and wherein the air tube length $L_{Air\ Tube}$ is equal to or greater than the bottleneck length $L_{Bottleneck}$ and equal to or less than about 25% of the bottle length $B_L$.

In at least one embodiment, the perimeter member engages the bottle by a friction fit. In at least one embodiment, the air tube comprises a flared portion. In at least one embodiment, the flared portion includes a flared portion base that does not extend distally beyond the bottleneck base. In at least one embodiment, the bottle insert further comprises at least one additional air tube. In at least one embodiment, the at least one additional air tube includes a length equal to or greater than the bottleneck length $L_{Bottleneck}$ and equal to or less than about 25% of the bottle length $B_L$.

One or more additional embodiments may comprise an air inlet channel in fluid communication with an air tube. Accordingly, a bottle insert for substantially equalizing atmospheric air pressure with air pressure within a bottle when pouring a liquid from the bottle is provided, the bottle having a bottle length $B_L$, the bottle including a bottleneck and a bottle opening having an opening diameter, the bottleneck having an interior bottleneck wall and a bottleneck length $L_{Bottleneck}$ extending between a bottle opening rim at the bottle opening to a bottleneck base at a top of a bottle taper of the bottle, the bottle opening rim circumscribing the bottle opening, the bottle insert comprising:

an air inlet channel adapted for contacting at least a portion of the interior bottleneck wall and extending circumferentially around at least a portion of the interior bottleneck wall, the air inlet channel including a perimeter member contacting at least a portion of the interior bottleneck wall, the air inlet channel including a distal base and an interior channel wall located substantially parallel to at least a portion of the perimeter member and offset radially to the interior of the perimeter member by the distal base; and an air tube attached to the air inlet channel and having a distal end extending equal to or less than about 25% of the bottle length $B_L$, at least a portion of the air tube in fluid communication with the air inlet channel.

In at least one embodiment, a top of the air inlet channel is situated within a rim proximity distance above or below the bottle opening rim, the rim proximity distance equal to or less than about 5% of the bottleneck length $L_{Bottleneck}$. In at least one embodiment, the bottle insert further comprises at least one additional air tube wherein the at least one additional air tube has an air tube diameter $D_{AirTube}$ between about 2% to 50% of the opening diameter of the bottle. In at least one embodiment, the bottle insert further comprises at least one additional air tube, the at least one additional air tube fluidly contiguous with the air inlet channel. In at least one embodiment, the bottle insert further comprises a flow block within the air inlet channel and situated between the air tube and the at least one additional air tube.

One or more additional embodiments are directed to a liquid containment and delivery device that mitigates the glugging phenomena. Accordingly, a liquid containment and delivery device is provided, comprising:

(a) a bottle having a bottle length $B_L$, the bottle including a bottleneck and a bottle opening having an opening diameter, the bottleneck having an interior bottleneck wall and a bottleneck length $L_{Bottleneck}$ extending between a bottle opening rim at the bottle opening to a bottleneck base at a top of a bottle taper of the bottle, the bottle opening rim circumscribing the bottle opening; and (b) a pressure reliever comprising an air tube attached to the interior bottleneck wall, the air tube including an upper inlet rim and a lower end edge, the air tube including an air tube length $L_{Air\ Tube}$ extending between the upper inlet rim of the air tube and the lower end edge of the air tube, wherein the upper inlet rim is positioned within about 0% to 5% of the bottleneck length $L_{Bottleneck}$ above or below the bottle opening rim, and wherein the air tube length $L_{Air\ Tube}$ is equal to or greater than the bottleneck length $L_{Bottleneck}$ and equal to or less than about 25% of the bottle length $B_L$.

In at least one embodiment, the air tube comprises a flared portion. In at least one embodiment, the flared portion includes a flared portion base that does not extend distally beyond the bottleneck base.

One or more embodiments include a pressure equalizer that includes an air tube having a flared portion. Accordingly, an article for holding and pouring a liquid is provided, comprising:

a bottle including a bottle wall having an interior surface defining a chamber, the chamber extending between a bottle opening and an interior bottom of the bottle, wherein the bottle opening is located at an end of a bottleneck of the bottle, the bottleneck including a bottleneck diameter smaller than a chamber diameter located along a bottle length extending between the bottle opening and the interior bottom; and a pressure equalizer located within the bottleneck and including at least one air tube with a flared proximal end having an inlet rim situated within a rim proximity distance of the bottle opening, the rim proximity distance equal to about 5% of the bottleneck length.

In at least one embodiment, the air tube has an air tube length no greater than about 25% of the bottle length. In at least one embodiment, a distal portion of the air tube extends into a handle of the bottle. In at least one embodiment, multiple air tubes are used and are situated substantially equidistant around an interior perimeter of the bottleneck. In at least one embodiment, the article further comprises a cap, the cap being detachably connected to the pressure equalizer for installation in the bottleneck when the cap is applied to the bottle.

In accordance with embodiments of the one or more present inventions, the air inlet tube variations can be combined. As an example, it is possible to combine one relatively small circular air inlet tube with one rectangular air inlet tube of larger size and two small triangular tubes that curve, all in one pressure equalizer device.

In use, if a bottle does not include a pressure equalizer that is integrally made with the bottle, an embodiment of a pressure equalizer insert can be inserted into the bottleneck of the subject bottle. The bottle is then tilted to pour the liquid contained in the bottle. While pouring the liquid, air enters the bottle via the one or more air tubes of the pressure equalizer as liquid exits the bottle via the open space situated around the one or more air tubes.

Various components are referred to herein as "operably associated." As used herein, "operably associated" refers to components that are linked together in operable fashion, and encompasses embodiments in which components are linked directly, as well as embodiments in which additional components are placed between the two linked components.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

As used herein, a bottle, jug or similar container device may simply be referred to as a "bottle."

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the one or more present inventions, a more particular description of the one or more present inventions is rendered by reference to specific embodiments thereof, which are illustrated in the appended drawings. It is appreciated that these drawings depict only typical embodiments of the one or more present inventions and are therefore not to be considered limiting of its scope. The one or more present inventions are described and explained with additional specificity and detail through the use of the accompanying drawings in which:

FIG. 10 is a top elevation view of the device shown in FIG. 8;

FIG. 11 is a top perspective view of an embodiment described herein;

FIG. 12 is a bottom perspective view of the device shown in FIG. 11;

FIG. 13 is a top perspective view of an embodiment described herein;

FIG. 14 is a bottom perspective view of the device shown in FIG. 13;

FIG. 15 is a top perspective view of an embodiment described herein;

FIG. 16 is a bottom perspective view of the device shown in FIG. 15;

FIG. 18 is a top perspective view of an embodiment described herein;

FIG. 19 is a bottom perspective view of the device shown in FIG. 18;

FIG. 20 is a top perspective view of an embodiment described herein;

FIG. 21 is a bottom perspective view of the device shown in FIG. 20;

FIG. 22 is a top perspective view of an embodiment described herein;

FIG. 23 is a bottom perspective view of the device shown in FIG. 22;

FIG. 24 is a top perspective view of an embodiment described herein;

FIG. 25 is a top elevation view of the device shown in FIG. 24;

FIG. 32 is a top perspective view of an embodiment described herein;

FIG. 33 is a bottom perspective view of the device shown in FIG. 32;

FIG. 34 is a top perspective view of an embodiment described herein;

FIG. 35 is a bottom perspective view of the device shown in FIG. 34;

FIG. 36 is a top elevation view of the device shown in FIG. 34;

FIG. 37 is a side cross-sectional view of the device shown in FIG. 34 (taken along line 37-37 as shown in FIG. 36);

The drawings are not necessarily to scale.

DETAILED DESCRIPTION

One or more embodiments of the one or more present inventions include a pressure equalizer insert for placement in a bottle to allow a liquid to be poured from the bottle while at the same time substantially equalizing air pressure within the bottle with atmospheric air pressure. As a result, the liquid can be poured from the bottle without the typical glugging phenomena that generally accompanies pouring liquid from a bottle that does not possess the pressure equalizer. One or more additional embodiments include bottles having bottlenecks with the pressure equalizer device integrally formed within the bottle during manufacture of the bottle. For example, a plastic bottle or jug can be manufactured with the pressure equalizer device integrally formed in the bottleneck of the bottle or jug when the bottle or jug is produced. The various embodiments of the one or more present inventions are described in the text below and are illustrated in the attached drawings.

Figure 1:
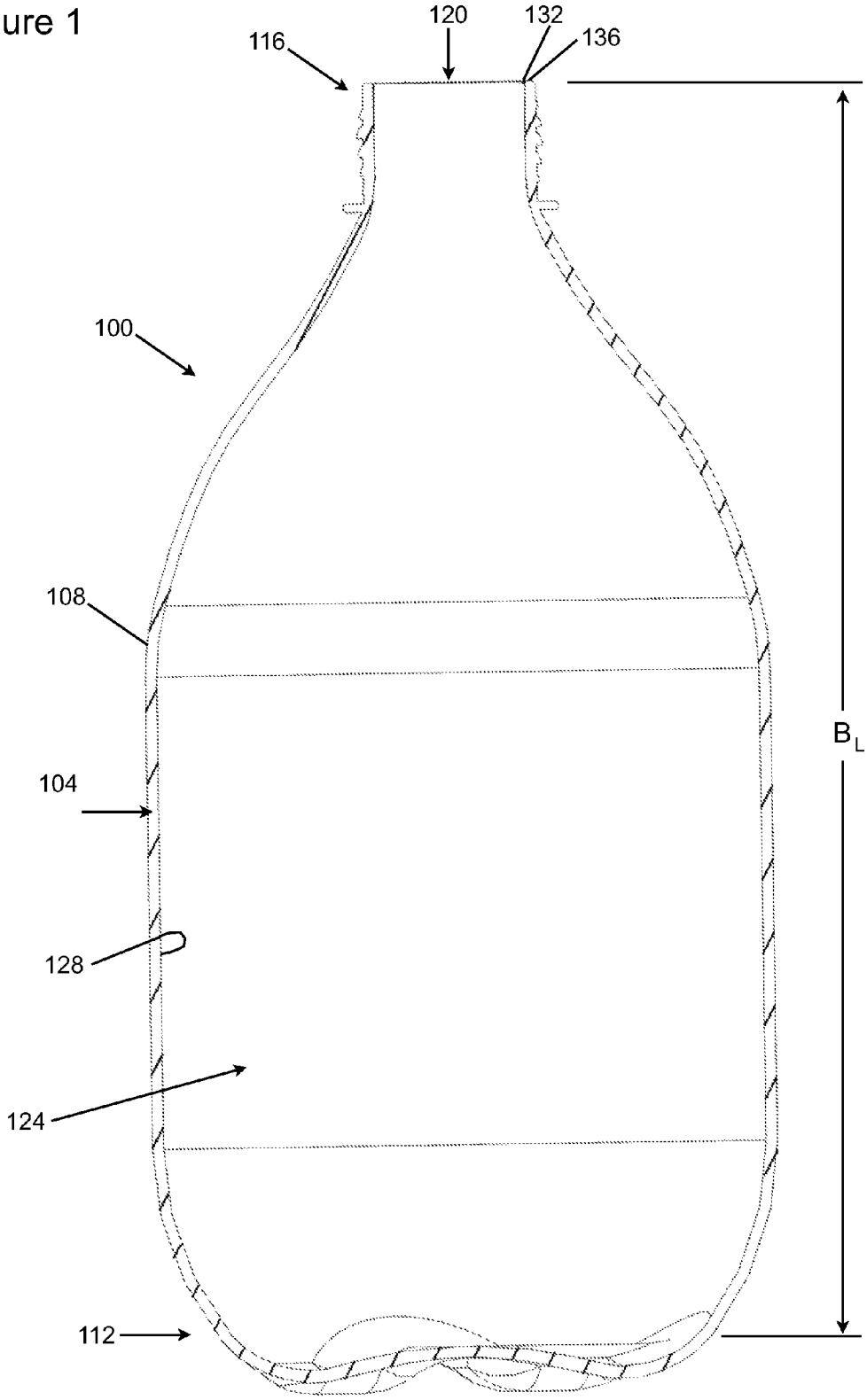
FIG. 1 is a side cross-sectional view (taken along line 1-1 as shown in FIG. 2) of a bottle.
Figure 2:
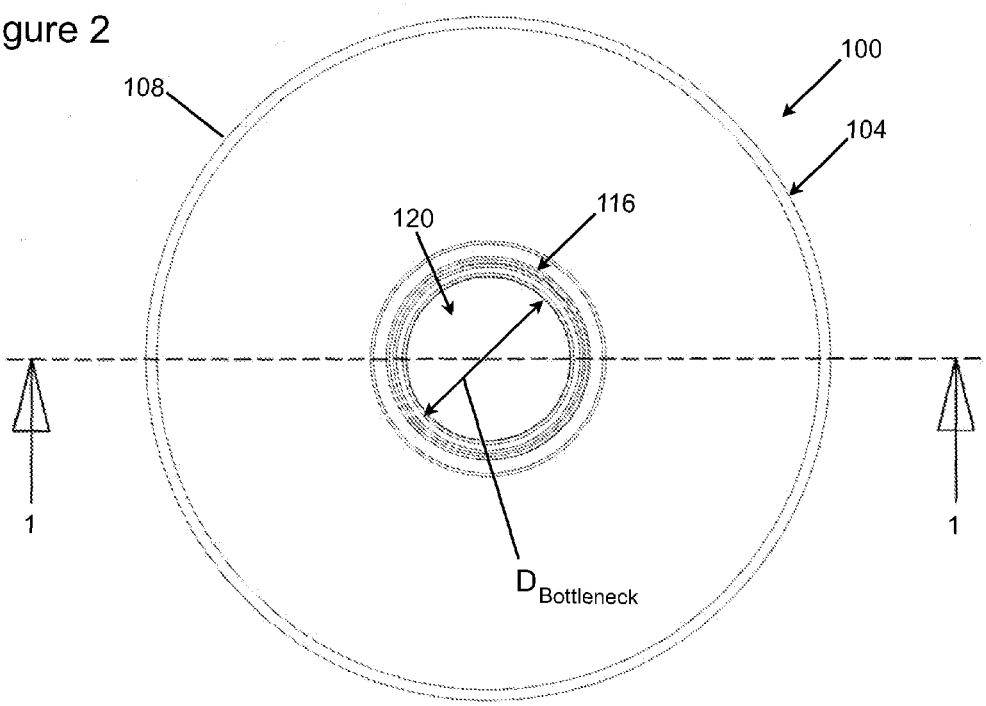
FIG. 2 is a top elevation view of the bottle depicted in FIG. 1.
Figure 3:
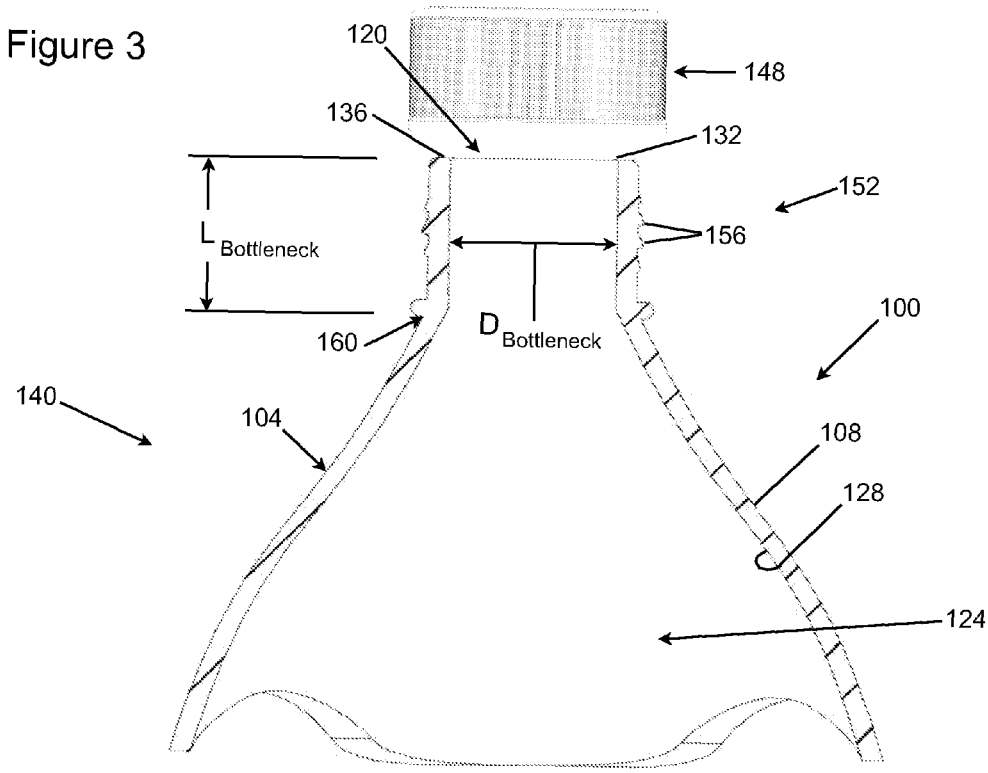
FIG. 3 is an enlarged cross-sectional view of the upper portion of the bottle depicted in FIG. 1.
Figure 4A:
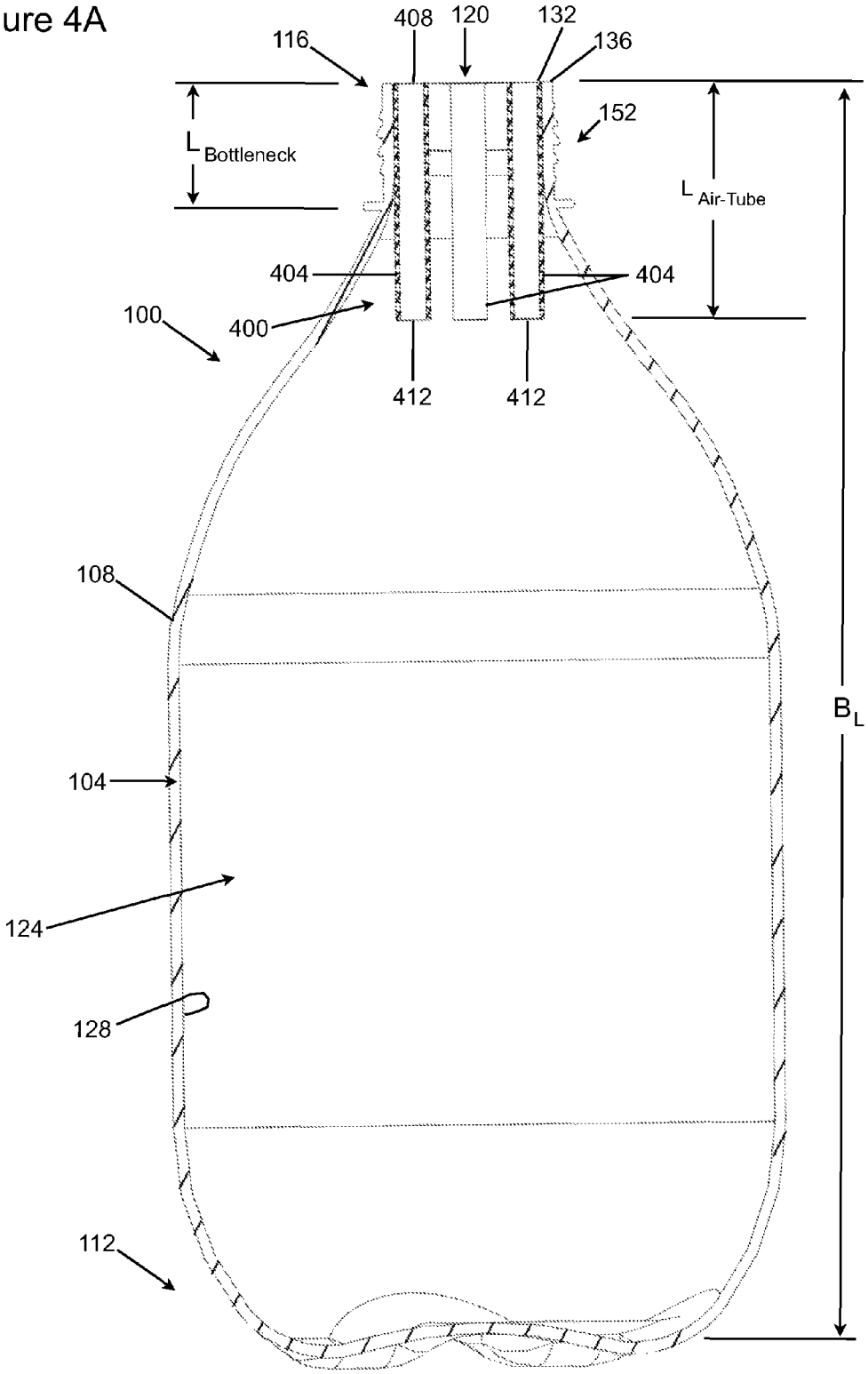
FIG. 4A is a side cross-sectional view (taken along line 4A-4A as shown in FIG. 5) of an embodiment described herein.
Figure 4B:
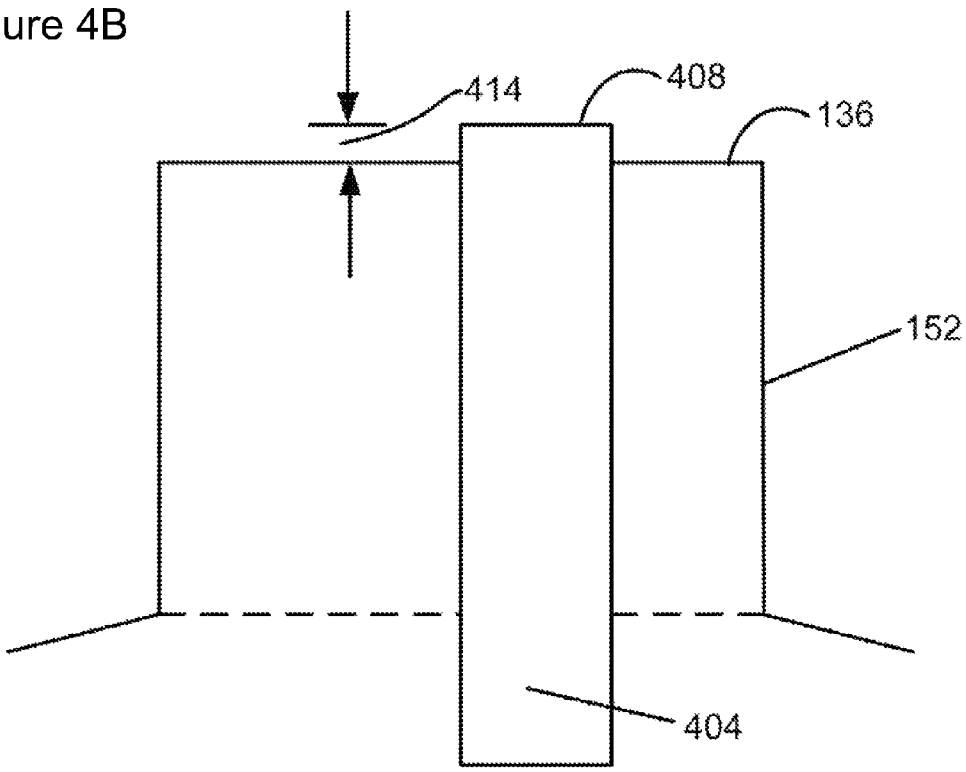
FIG. 4B is a detailed view of a bottleneck illustrating a rim proximity distance.
Figure 4C:
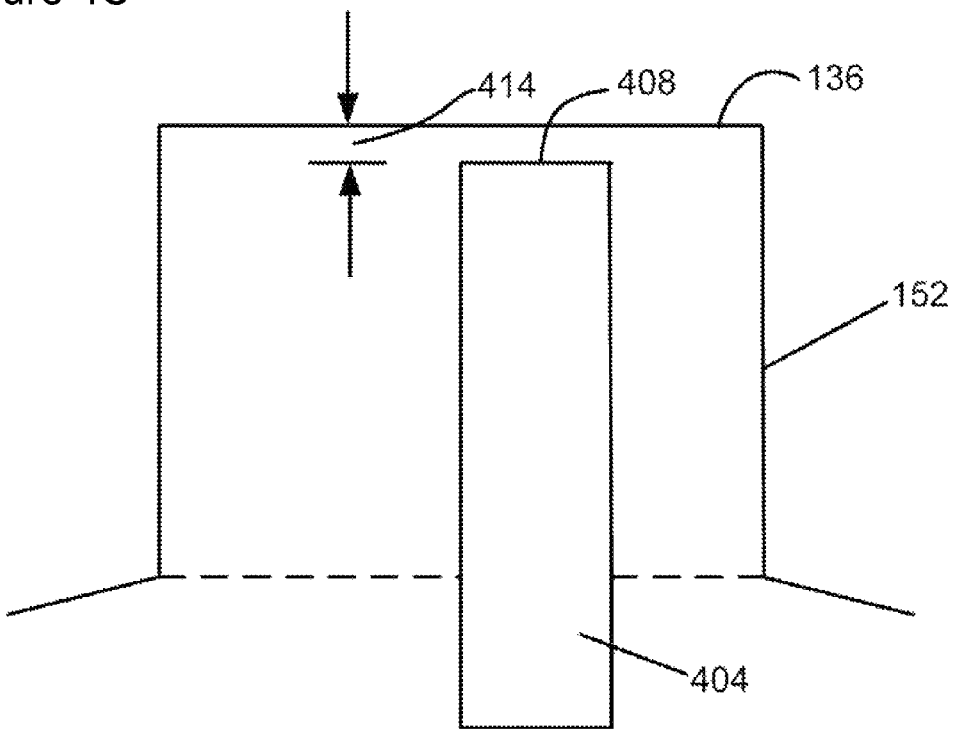
FIG. 4C is another detailed view of a bottleneck illustrating a rim proximity distance.
Figure 5:
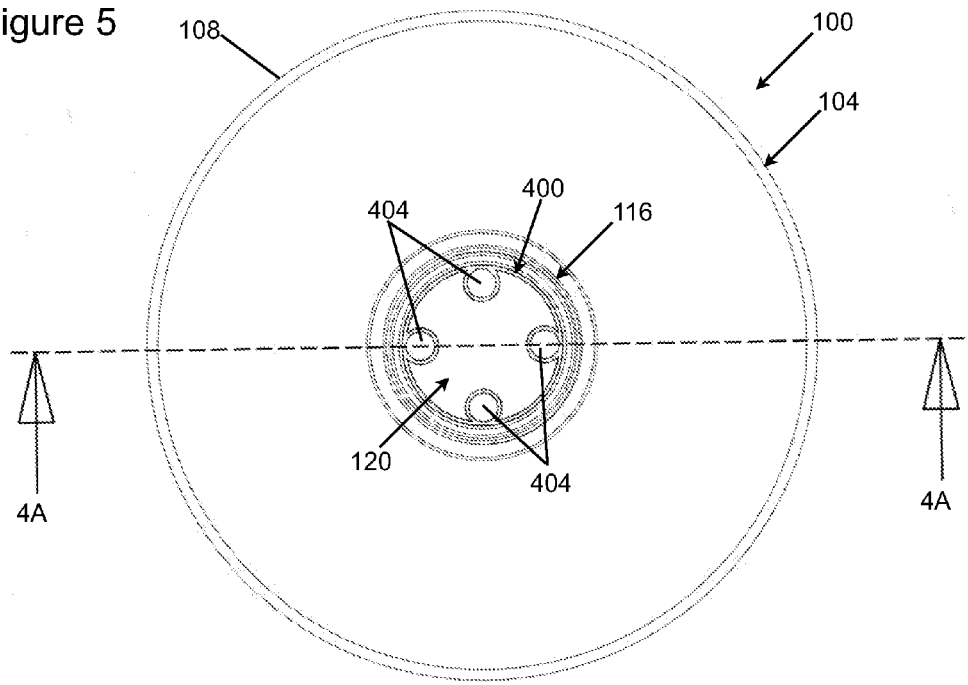
FIG. 5 is a top elevation view of the device shown in FIG. 4A.
Figure 6:
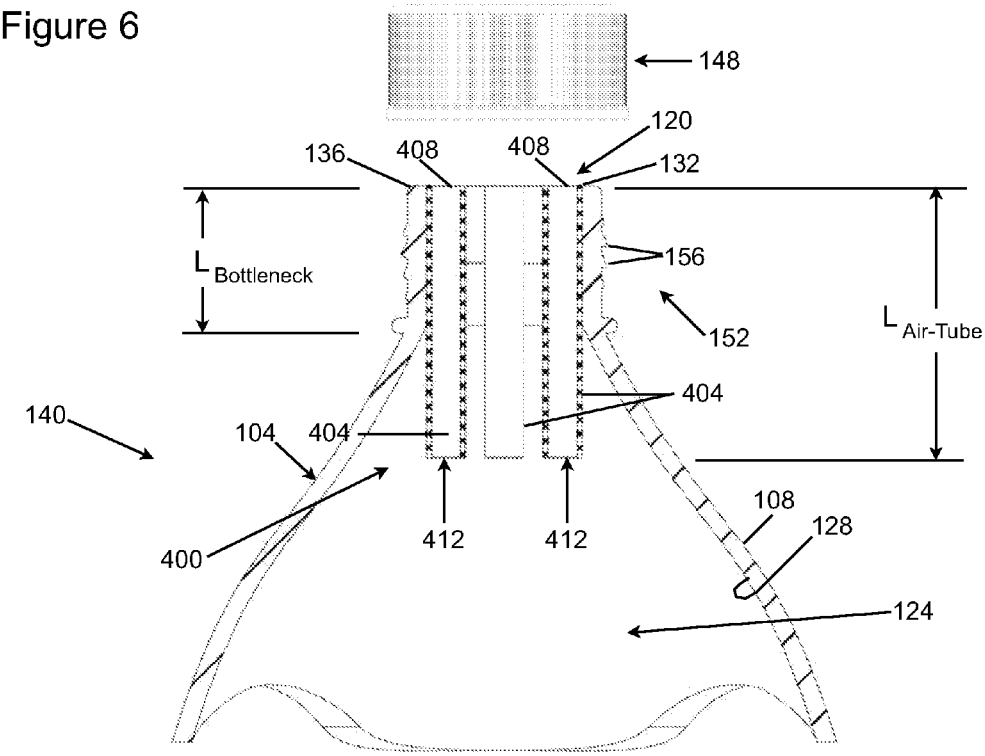
FIG. 6 is an enlarged cross-sectional view of the upper portion of the bottle depicted in FIG. 4A.
Figure 7:
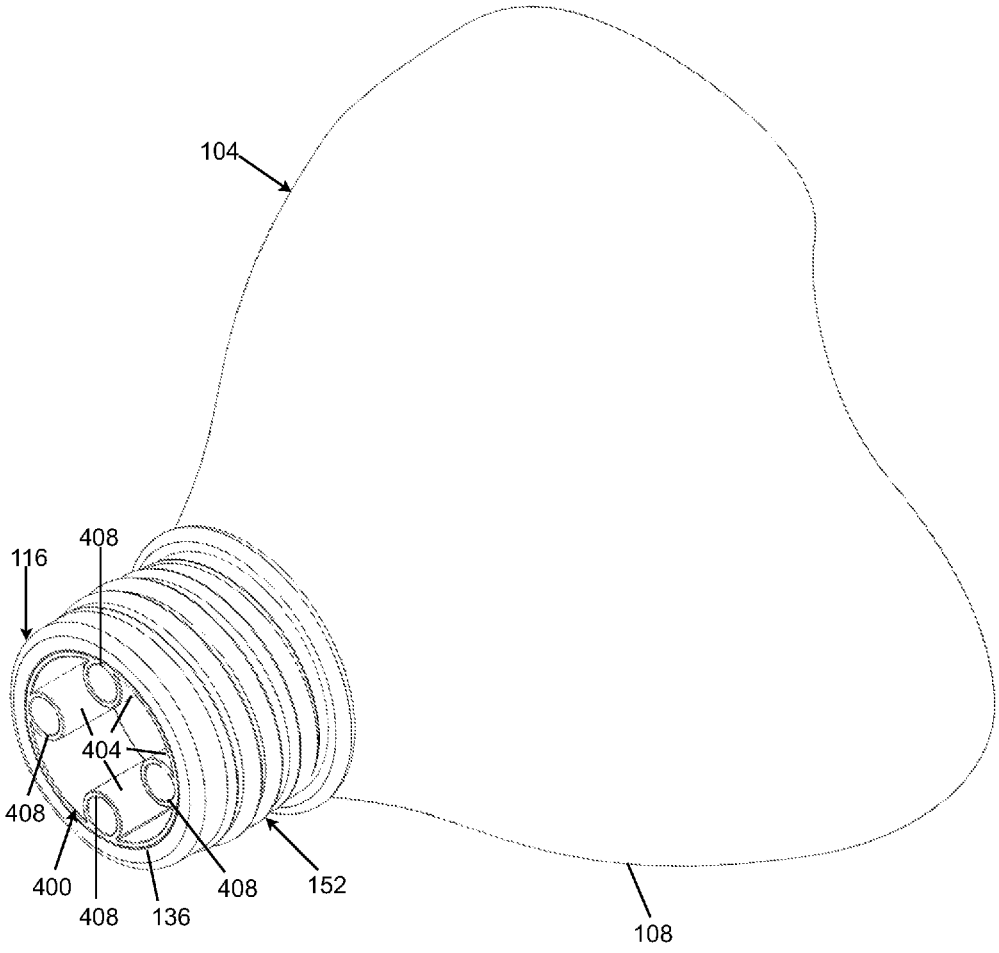
FIG. 7 is an enlarged perspective view of the upper portion of the bottle depicted in FIG. 6.

Referring now to FIG. 4A, a bottle 100 is shown that includes an embodiment of a pressure equalizer 400 inserted into the bottle 100. More particularly, FIG. 4A depicts a bottle 100 and a pressure equalizer 400 in a cross-sectional view, wherein the cross-sectional alignment is taken along line 4A-4A of the top elevation view of the bottle 100 and pressure equalizer 400 depicted in FIG. 5. The pressure equalizer 400 is located, at least in part, in the bottleneck 152 of the bottle 100. In at least one embodiment, the pressure equalizer 400 includes at least one air tube 404. As depicted in FIGS. 4A-10, the pressure equalizer 400 is shown with four air tubes 404; however, it is to be understood that embodiments of the pressure equalizer 400 may include more or less than four air tubes 404. More specifically, and as will be discussed in more detail below, one or more embodiments include a single air tube 404, while other embodiments include two or more air tubes 404. Accordingly, the number of air tubes 404 may vary for a given application.

Figure 42:
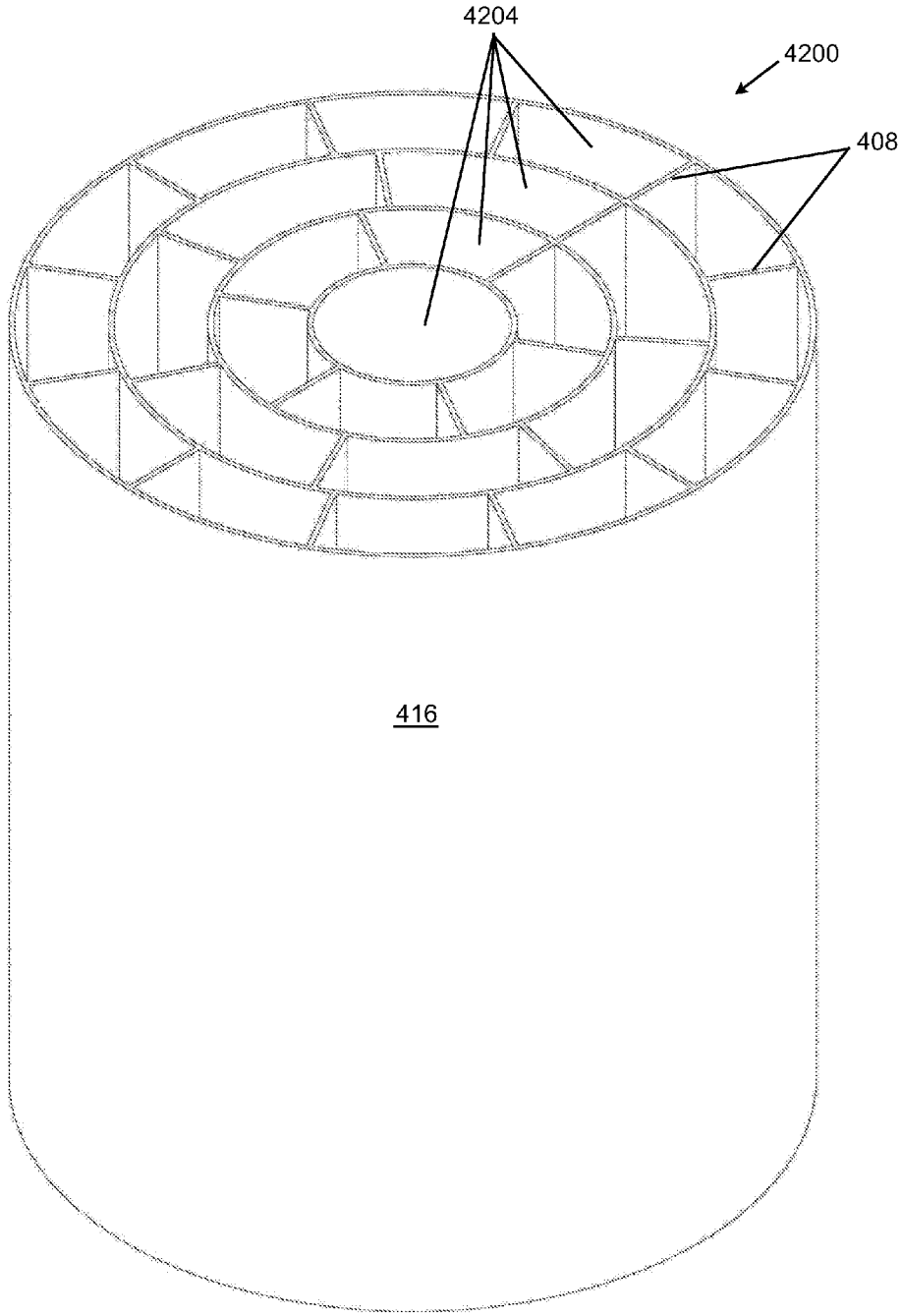
FIG. 42 is a side perspective view of an embodiment described herein.
Figure 43:
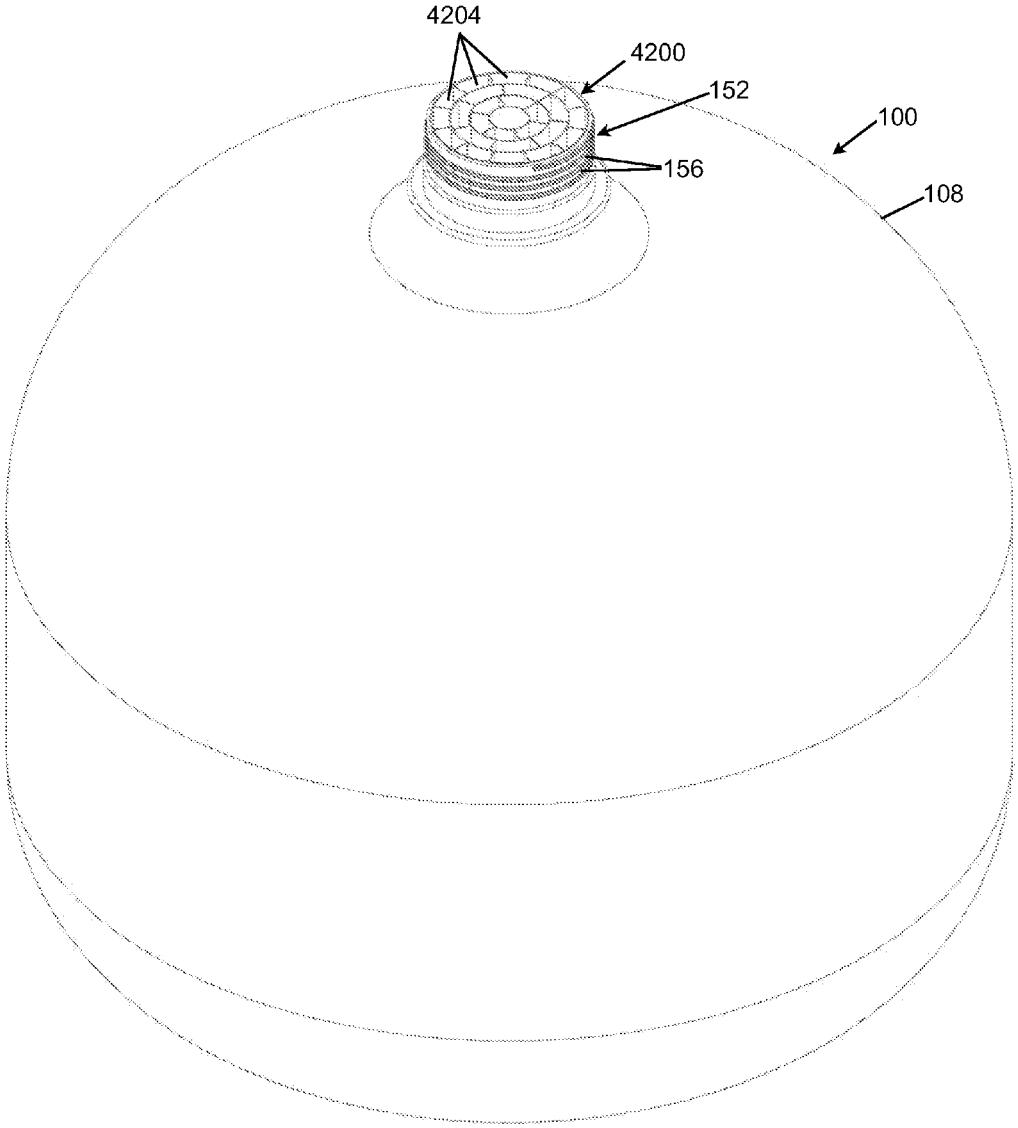
FIG. 43 is a top perspective view of an embodiment described herein.

With continued reference now to FIGS. 4A-10, each air tube 404 is sized to have an air tube diameter $D_{AirTube}$ of between about 2% to 50% of the bottleneck diameter $D_{Bottleneck}$. Here it is noted that for pressure equalizers using small air tubes, multiple air tubes are preferably used for situations where the air tube diameters $D_{AirTube}$ are at or around 2% of the bottleneck diameter $D_{Bottleneck}$. Although air tubes may occupy the entire interior space of the bottleneck (as shown in FIGS. 42 and 43 and discussed below), for any given air tube 404 the diameter or equivalent diameter (allowing for different shaped air tubes, also discussed below) for the air tubes 404 preferably does not exceed 50% of the bottleneck diameter $D_{Bottleneck}$. In addition, any given air tube 404 should not be so small as to induce capillary rise of the liquid within the bottle. Accordingly, by way of example and not limitation, a bottle having a bottleneck diameter $D_{Bottleneck}$ (that is, an inside diameter) of approximately 0.875 inches could receive a pressure equalizer 400 with a variety of number and size air tubes, such as air tubes 404 whose diameters vary between about 0.0018 inches (2% of 0.875 inches) and about 0.438 inches (50% of 0.875 inches).

Referring still to FIGS. 4A-10, and in accordance with at least one embodiment of the one or more present inventions, the air tubes 404 include an upper inlet rim 408 and a lower end edge 412. Accordingly, the air tubes 404 have an air tube length $L_{Air\ Tube}$ extending between the upper inlet rim 408 and the lower end edge 412. In at least one embodiment, the upper inlet rim 408 is configured for positioning substantially even with the bottle rim 136. Alternatively, in at least one embodiment the upper inlet rim 408 of the air tubes 404 is situated within a rim proximity distance 414 of about 5% of the bottleneck length $L_{Bottleneck}$ either above (as best seen in FIG. 4B) or below (as best seen in FIG. 4C) of the bottle rim 136. In addition, in at least one embodiment, the air tube length $L_{Air\ Tube}$ is equal to or greater than the bottleneck length $L_{Bottleneck}$ and equal to or less than about 25% of the bottle length $B_L$ (i.e., $L_{Bottleneck} \leq L_{Air}$ Tube$\leq 25\%\ B_L$). Accordingly, by way of example and not limitation, a bottle having a bottleneck length $L_{Bottleneck}$ of 1.0 inch and a bottle length $B_L$ of 8.0 inches could receive a pressure equalizer 400 that includes one or more air tubes 404 whose upper inlet rim 408 is within 0.05 inches (5% of 1.0 inch) above or below the bottle rim 136, and whose air tube length $L_{Air\ Tube}$ is greater than or equal to 1.0 inch (the value of the bottleneck length $L_{Bottleneck}$) and less than or equal to about 2.5 inches (25% of 8.0 inches).

Figure 8:
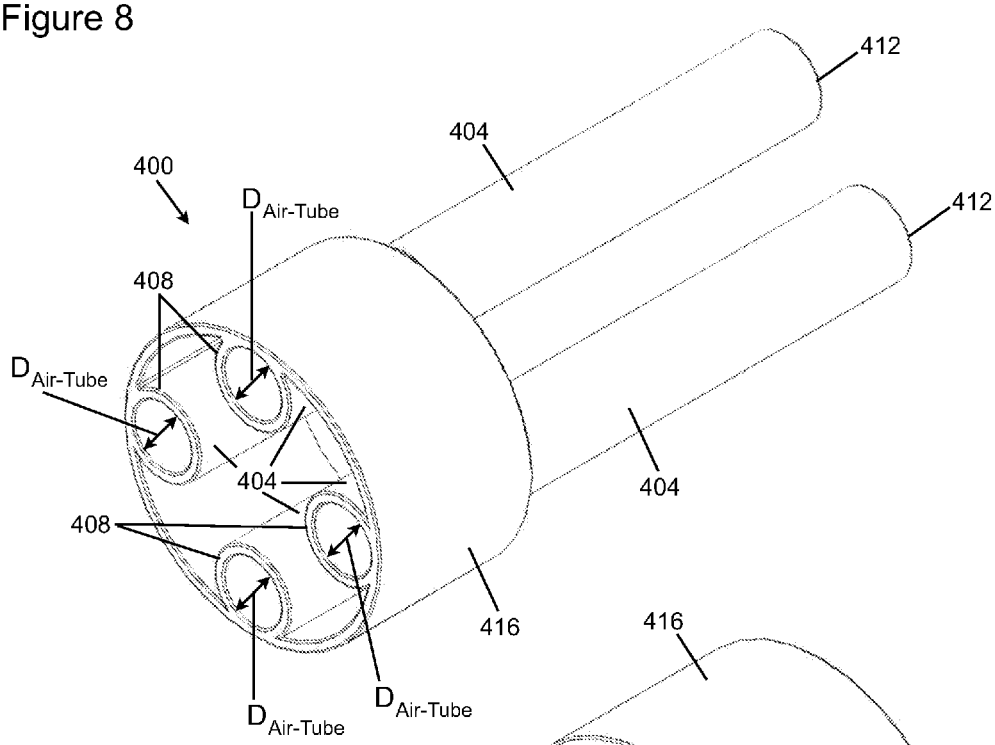
FIG. 8 is a top side perspective view of an embodiment described herein.
Figure 9:
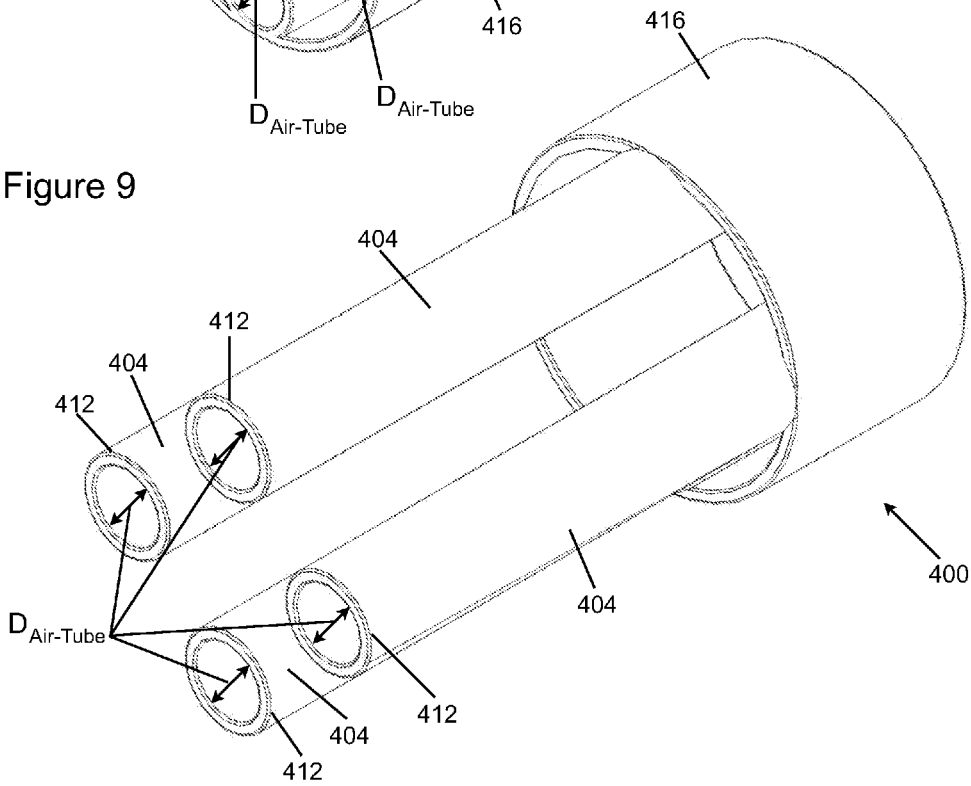
FIG. 9 is a bottom side perspective view of the device shown in FIG. 8.

Referring now to FIGS. 8 and 9, perspective views of pressure equalizer 400 are shown. As described above, the pressure equalizer 400 includes a plurality of air tubes 404, and more specifically, four air tubes 404 are shown arranged substantially equidistant around the circumference and within a perimeter member 416. For embodiments wherein the pressure equalizer 400 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 400 is integrally formed as part of the bottle 100, then the air tubes 404 may be positioned directly around the interior surface 128 of the bottleneck 152.

Referring now to FIG. 10, in at least one embodiment the thickness of the perimeter member 416 includes a portion of the wall of the air tube 404. More particularly, each air tube 404 includes a tube wall thickness $T_{Air\ Tube\ Wall}$. The tube wall thickness $T_{Air\ Tube\ Wall}$ forms a portion of the perimeter member 416. Or, said differently, a portion of the perimeter wall thickness $T_{Perimeter\ Wall}$ forms a portion of the air tube 404.

As noted above, pressure equalizers with one or more air tubes comprise various embodiments of the one or more present inventions. With reference now to FIGS. 11 and 12, a pressure equalizer 1100 is shown comprising a plurality of air tubes 404, and more specifically, three air tubes 404. The air tubes 404 of pressure equalizer 1100 are situated substantially at equal distances from one another around the circumference of the perimeter member 416. Again, for an insert, the perimeter member 416 is adapted to engage at least a portion of the interior surface 128 of the bottleneck 152 of a bottle 100. If made integrally with the bottle 100, then the three air tubes 404 of pressure equalizer 1100 are attached to a portion of the interior surface 128 of the bottle wall 104 of the bottleneck 152 of a bottle 100.

Referring now to FIGS. 13 and 14, and in accordance with at least one embodiment, a pressure equalizer 1300 is shown that includes a plurality of air tubes 1304, wherein the air tubes have a cross-sectional shape other than circular. More specifically, the air tubes 1304 comprises a perimeter section 1308 having an arc 1310 that substantially matches the curvature of a portion of the perimeter member 416 (for an insert) or the interior surface 128 of the bottleneck 152 (for an integrally formed pressure equalizer). The air tubes 1304 further include a substantially planar interior portion 1312. In cross section, the air tubes 1304 are substantially that of a segment of a circle. Although of a different cross-sectional shape, the air tubes 1304 preferably include an equivalent diameter (by measuring the cross-sectional area of the air tube 1304 and solving for an equivalent diameter) that resides within the prescribed range of about 2% to 50% of the bottleneck diameter $D_{Bottleneck}$. In addition, the length of the air tubes 1304 preferably also be within the prescribed values given above (that is, $L_{Bottleneck} \leq L_{Air\ Tube} \leq 25\%\ B_L$). Use of a portion of the perimeter member 416 as part of the air tubes 1304 is advantageous because less materials are used in the manufacturing process.

Referring now to FIGS. 15 and 16, in at least one embodiment a pressure equalizer 1500 comprises air tubes 404 that include curved portions along their longitudinal length, such as along distal portions of their length. Such distal curved portions 1504 may provide advantageous routing of air as fluid exits the liquid flow channel of the pressure equalizer and air enters the bottle through the air tubes 404.

Figure 17:
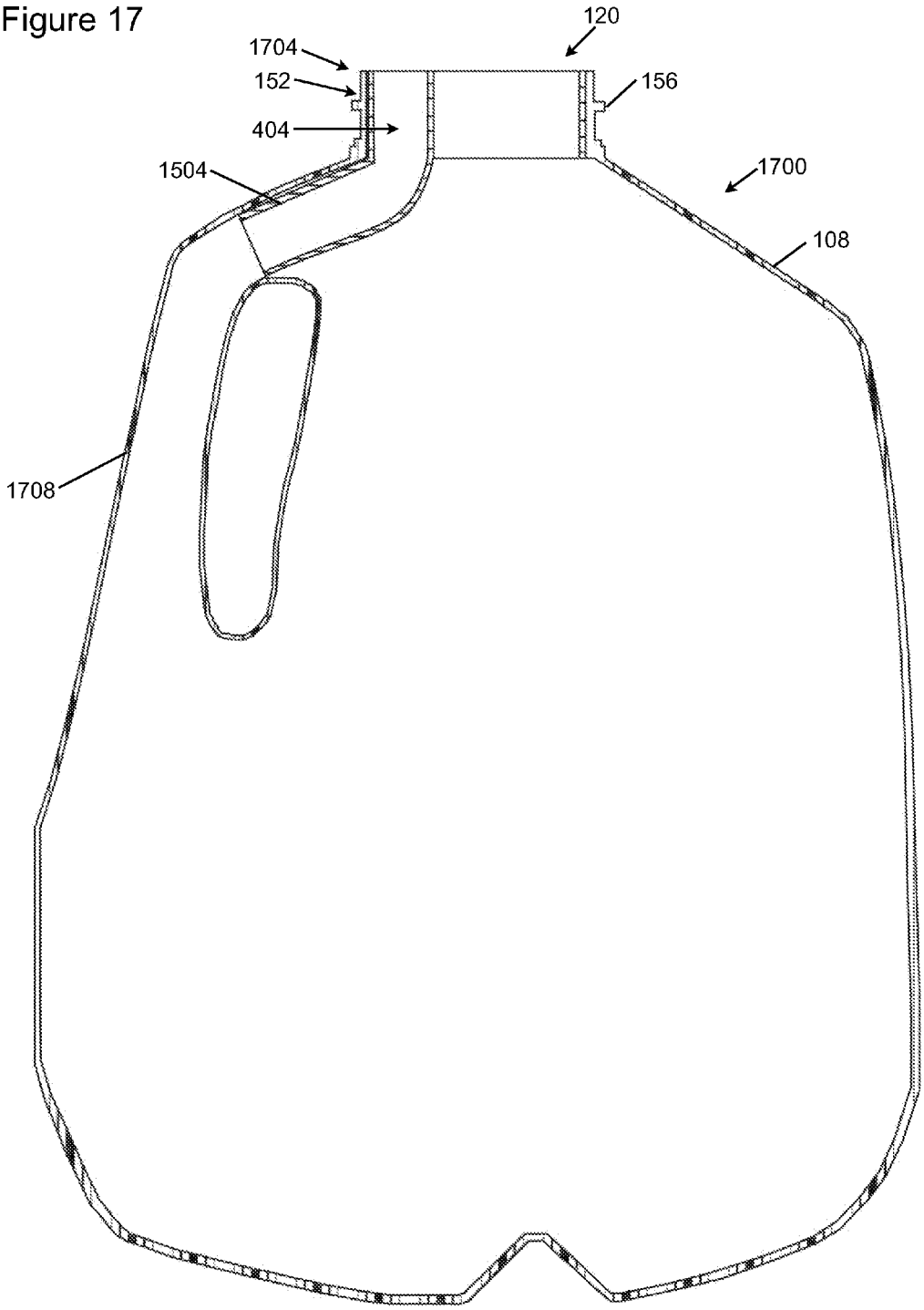
FIG. 17 is a side cross-sectional view of an embodiment described herein.
Figure 26:
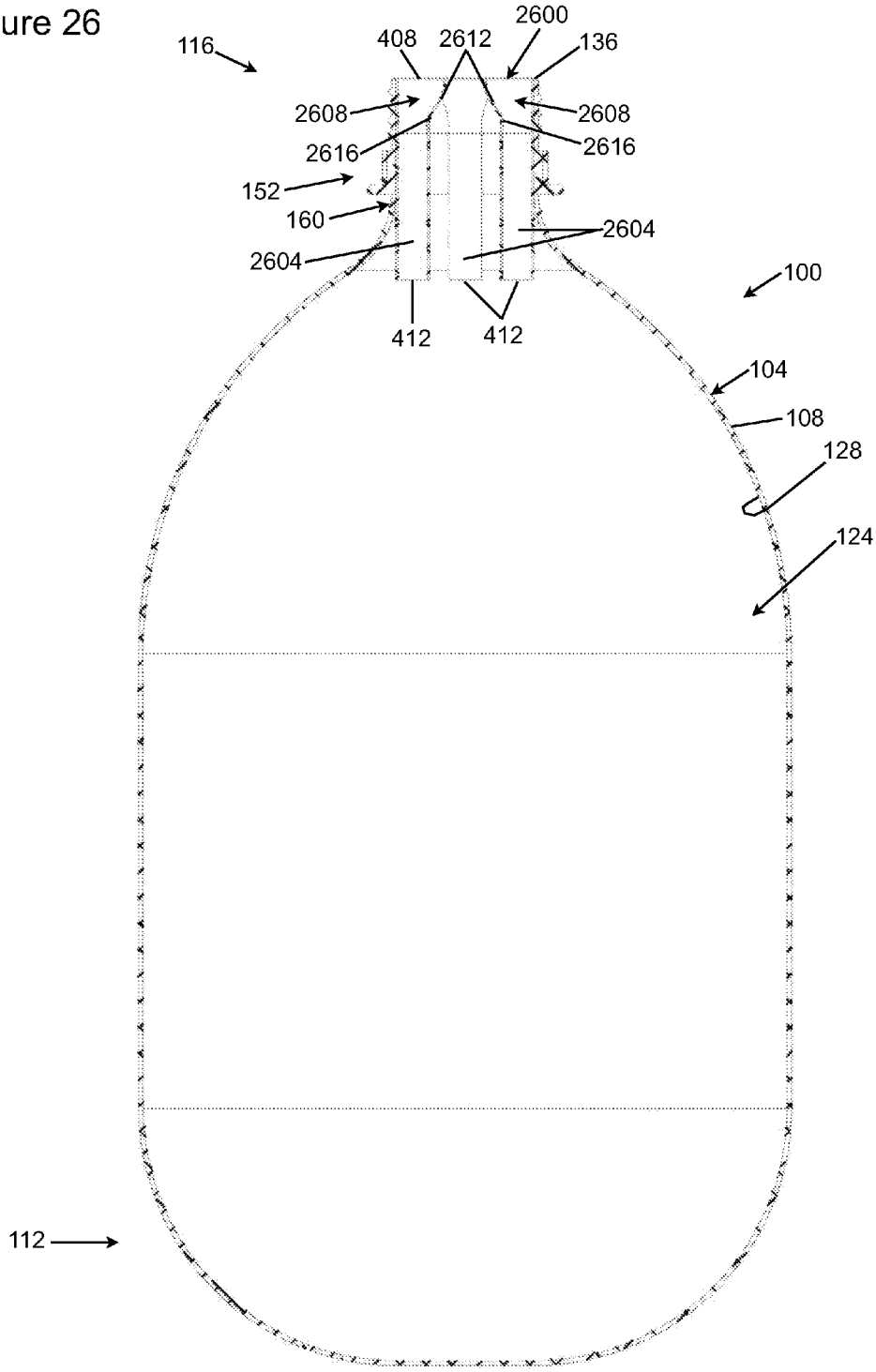
FIG. 26 is a side cross-sectional of an embodiment described herein.
Figure 27:
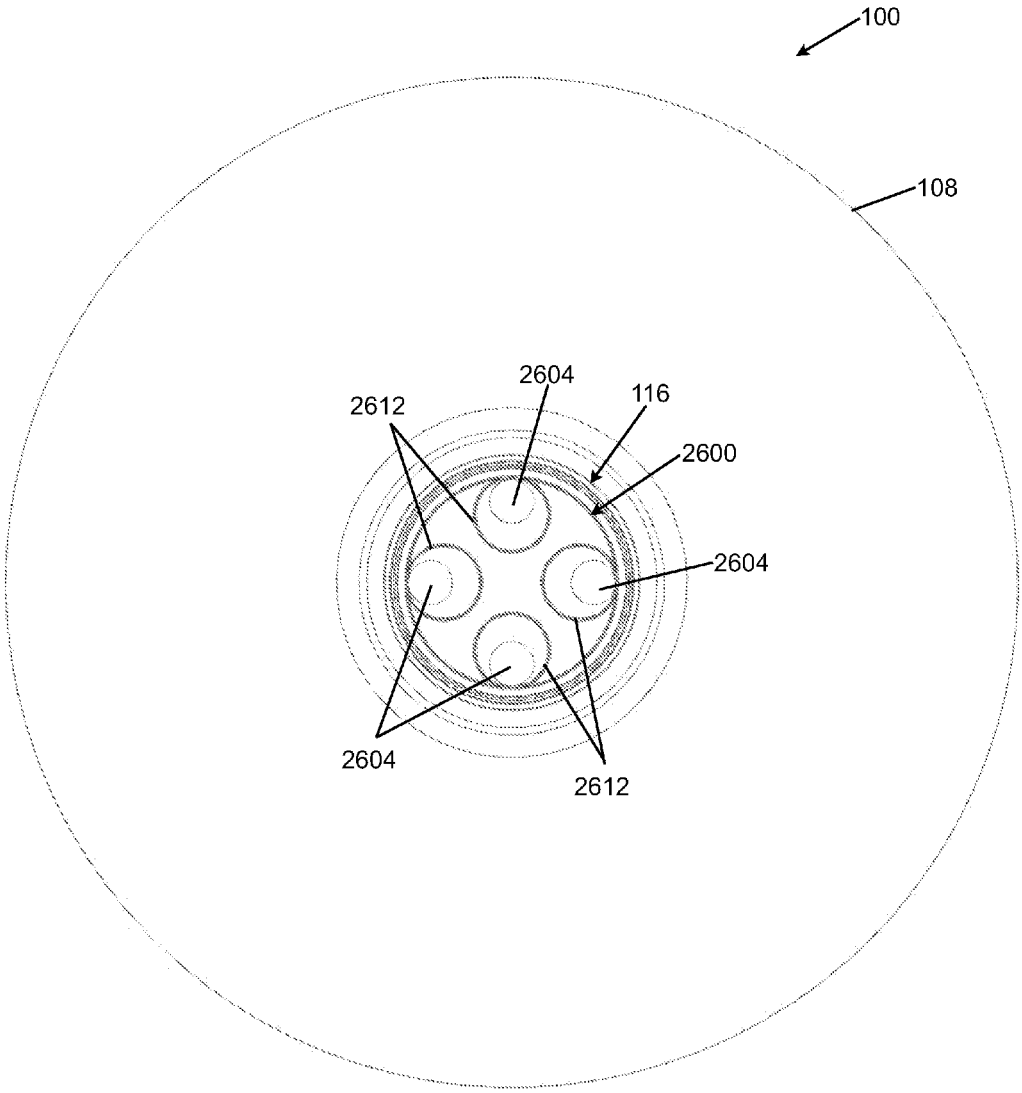
FIG. 27 is a top elevation view of the device shown in FIG. 26.

With reference now to FIG. 17, and in accordance with at least one embodiment of the one or more present inventions, a bottle in the form of a jug 1700 is shown that includes a pressure equalizer 1704 comprising a single air tube 404 having a curved distal portion 1504. The curved distal portion 1504 extends into a handle 1708 of the jug 1700. Accordingly, a single air tube located opposite the side of pour can prevent the glugging effect. FIGS. 18 and 19 illustrate top and bottom perspective views, respectively, of an insert type of pressure equalizer 1704.

Referring now to FIGS. 20-23, and in accordance with at least one embodiment, a series of pressure equalizers are shown that include a single air tube having cross-sectional area shapes different from a circle. More particularly, FIGS. 20 and 21 illustrate a pressure equalizer 2000 with air tubes 2004, wherein the air tubes 2004 comprise a substantially rectangular cross-sectional area shape. FIGS. 22 and 23 illustrate a pressure equalizer 2200 with air tubes 2204, wherein the air tubes 2204 comprise a substantially triangular cross-sectional area shape. Here, it noted that the air tubes 2004 and 2204 comprise a perimeter portion 2008 and 2208 that substantially match the curvature of a portion of the perimeter member 416. That is, an arc 1310 is associated with the perimeter portions 2008 and 2208 that substantially match the curvature of a portion of the perimeter member 416 (for an insert) or the interior surface 128 of the bottleneck 152 (for an integrally formed pressure equalizer).

Referring now to FIGS. 24 and 25, a pressure equalizer 2400 is shown that includes a single air tube 404, wherein the air tube is interiorly offset from perimeter wings, the perimeter wings constituting modified perimeter member. For pressure equalizer 2400, the air tube 404 resides along struts 2408 that interconnect the air tube 404 to a first perimeter wing 2404*a* and a second perimeter wing 2404*b*. As with other embodiments described herein, for embodiments wherein the pressure equalizer 2400 is an insert, the perimeter wings 2404*a* and 2404*b* are configured to fixedly engage (e.g., by friction fit, threads, welding, adhesive, and/or fastener) the interior surface 128 of the bottleneck 152 of the bottle 100. Alternatively, if the pressure equalizer 2400 is integrally formed as part of the bottle 100, then struts 2408 interconnect the air tube 404 to the interior surface 128 of the bottleneck 152.

For the various embodiments of the pressure equalizers described above, the cross-sectional areas of the air tubes are depicted as being substantially constant from the upper inlet rim 408 to the lower end edge 412 of each air tube 404. However, it is to be understood that the cross-sectional areas may vary. Moreover, with reference now to FIGS. 26-29, and in accordance with at least one embodiment of the one or more present inventions, a pressure equalizer 2600 is provided having one or more air tubes 2604, wherein the air tubes 2604 include a proximal end 2608 with a flared portion 2612. Accordingly, because of the presence of the flared portion 2612, the cross-sectional area of the air tube 2604 decreases along at least a portion of the longitudinal length of the air tube 2604. That is, from the upper inlet rim 408 to the flared portion base 2616. In at least one embodiment, the flared portion 2612 extends distally no further than the bottleneck base 160 of the bottleneck 152. From the flared portion base 2616 of the flared portion 2612 to the lower end edge 412 of the air tubes 2604, the air tubes 2604 have a substantially constant air tube diameter $D_{Air\ Tube}$ that resides within the prescribed range of about 2% to 50% of the bottleneck diameter $D_{Bottleneck}$. In addition, the length of the air tubes 2604 preferably also be within the prescribed values given above (that is, $L_{Bottleneck} \leq L_{Air\ Tube} \leq 25\%\ B_L$). Use of a flared portion 2612 as part of the air tubes 2604 is advantageous because it assists in routing the liquid away from the top of the air tubes, thereby mitigating the top of the air tubes from being flooded by the liquid exiting the container, allowing air to more easily enter the air inlet tubes.

Figure 28:
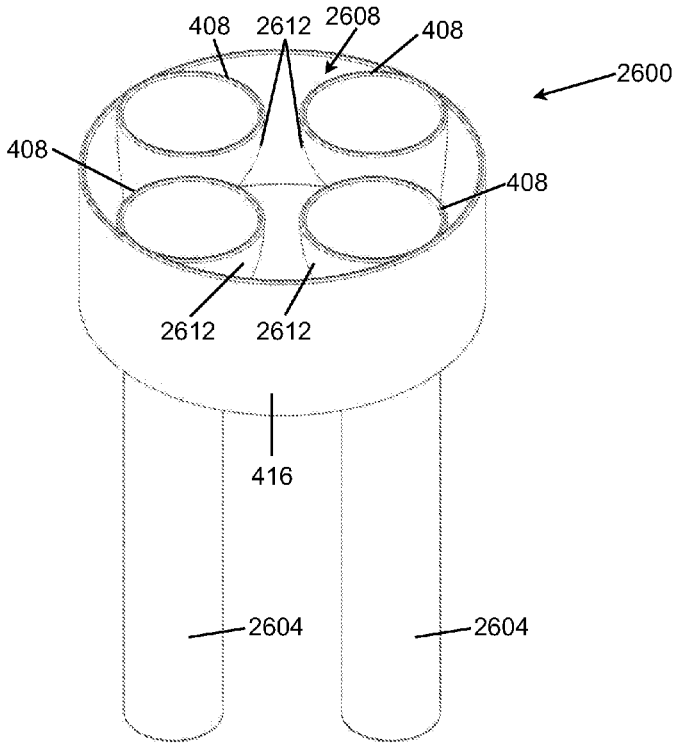
FIG. 28 is a top perspective view of an embodiment described herein.
Figure 29:
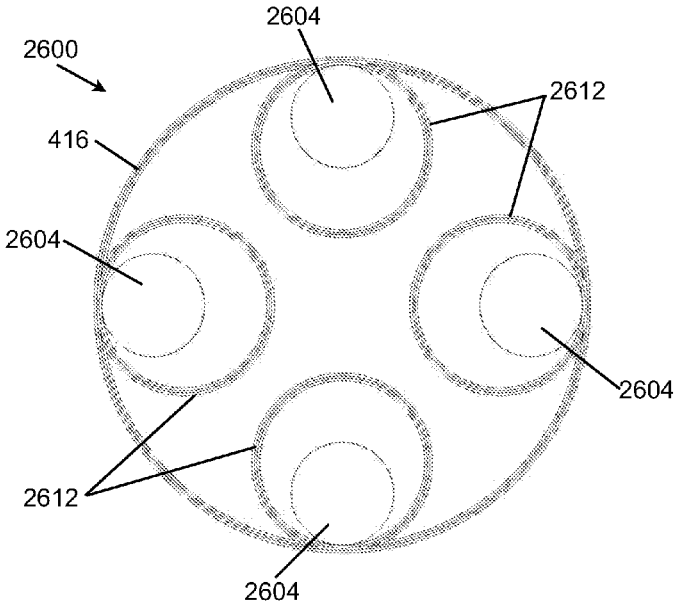
FIG. 29 is a top elevation view of the device shown in FIG. 28.

With reference now to FIGS. 28 and 29, the pressure equalizer 2600 is depicted as an insert. Accordingly, for embodiments wherein the pressure equalizer 2600 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 2600 is integrally formed as part of the bottle 100, then the air tubes 2604 are positioned directly around the interior surface 128 of the bottleneck 152.

Figure 30:
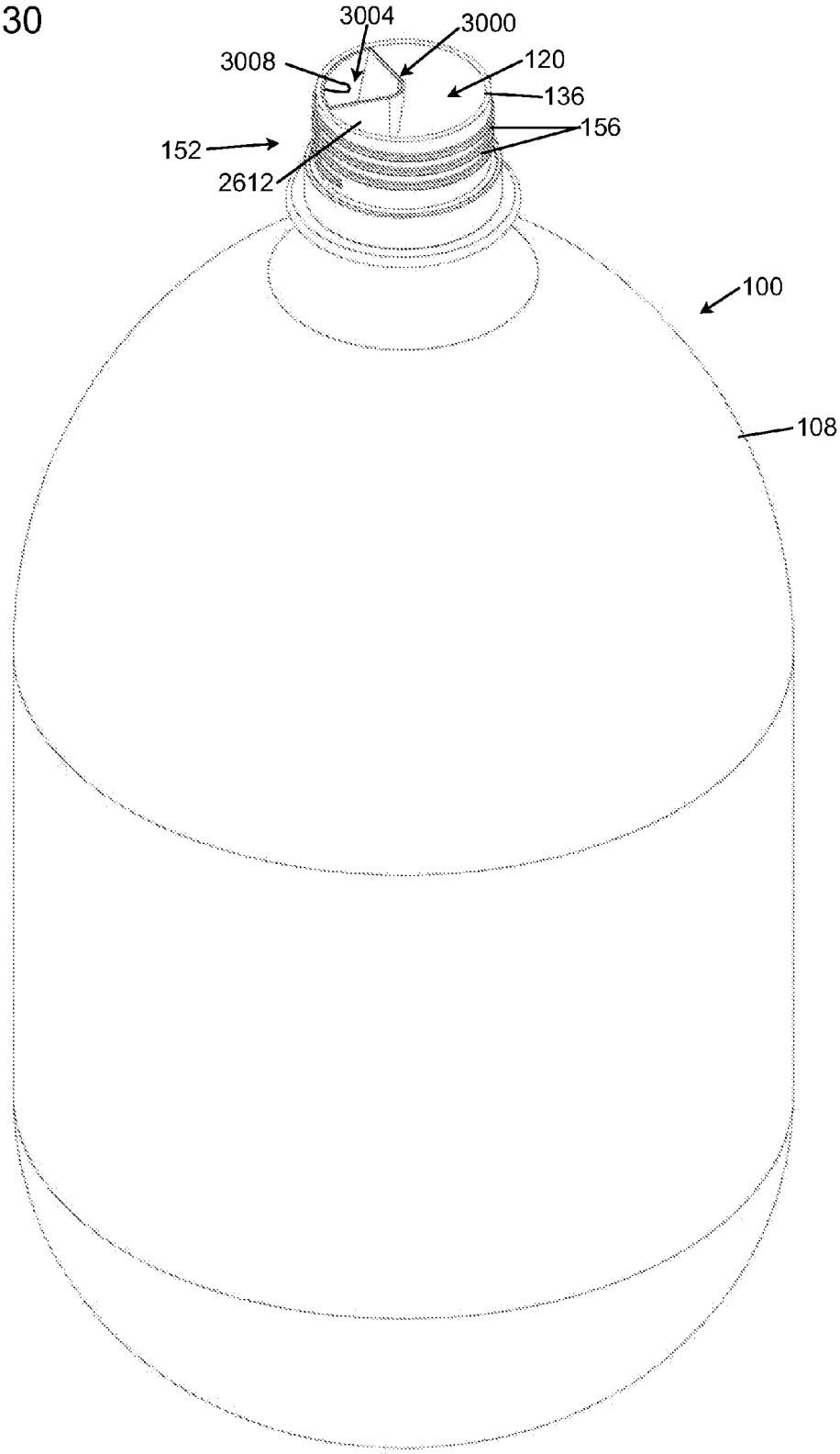
FIG. 30 is a top perspective view of an embodiment described herein.
Figure 31:
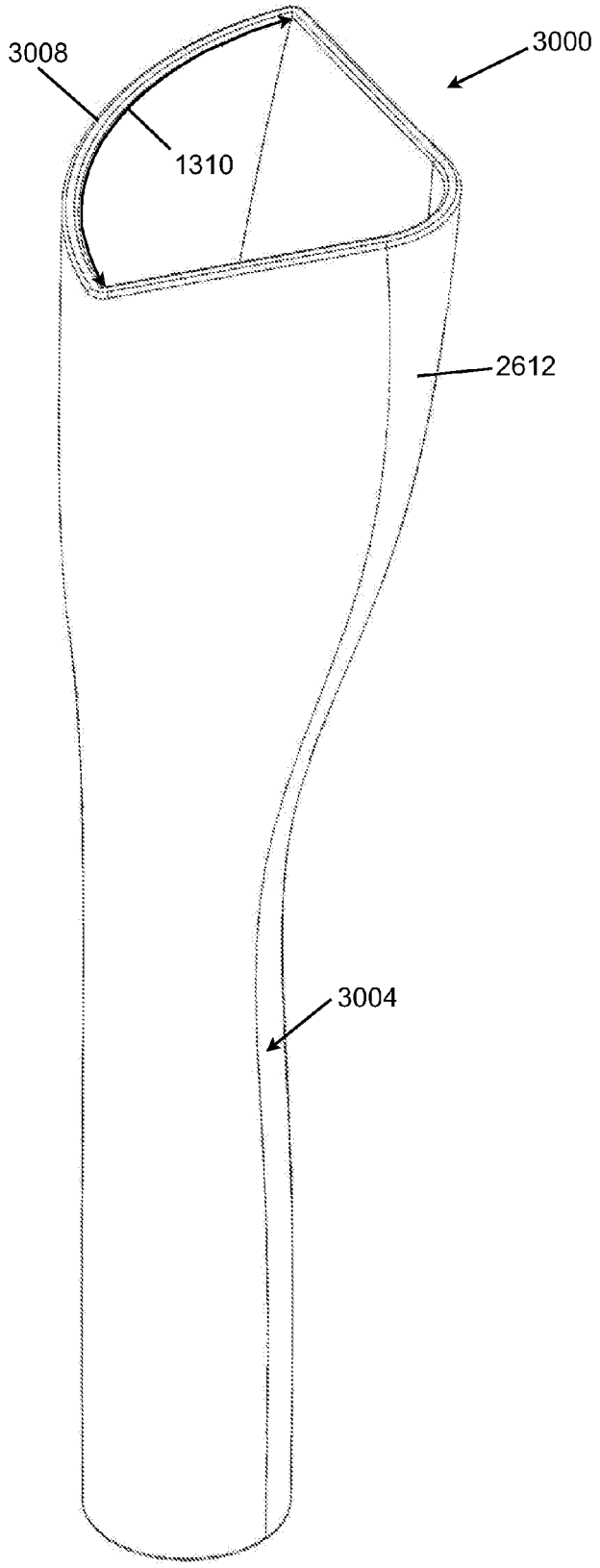
FIG. 31 is a top perspective view of an embodiment described herein and forming a portion of the device shown in FIG. 30.

Referring now to FIG. 30, and in accordance with at least one embodiment of the one or more present inventions, a bottle 100 is shown that includes pressure equalizer 3000 that includes a single air tube 3004. As best seen in FIG. 31, the single air tube 3004 includes a flared portion 2612. In at least one embodiment, the flared portion includes an arc 1310 associated with a perimeter portion 3008 that substantially matches the curvature of a portion of the perimeter member 416 (for an insert) or the interior surface 128 of the bottleneck 152 (for an integrally formed pressure equalizer). Use of a flared portion 2612 as part of the air tube 3004 is advantageous because a single air tube 3004 can be associated with a bottle without a handle and the liquid can be poured without glugging and without regard to the direction that the bottle is oriented.

Referring now to FIGS. 32 and 33, in at least one embodiment a pressure equalizer 3200 includes a perimeter air inlet channel 3204 and one or more air tubes 3208. The air tubes 3208 are in fluid communication with the perimeter air inlet channel 3204 to facilitate flow of air from the perimeter air inlet channel 3204 to the one or more air tubes 3208 when liquid is being poured from a bottle having the pressure equalizer 3200. As shown in FIG. 32, the perimeter air channel 3204 includes a perimeter member 416, a base 3300 (as best seen in FIG. 33), and an interior channel wall 3216 that is substantially parallel to the perimeter member 416, but offset radially to the interior of the perimeter member 416. The base 3300 may be a sloped region between the perimeter member 416 and the interior channel wall 3216. Again, for embodiments wherein the pressure equalizer 3200 is an integral portion of a bottle, the perimeter member 416 may be a portion of the bottle wall 104, such as a portion of the bottleneck 152. In at least one embodiment, an upper rim 3228 of the perimeter air inlet channel 3204 substantially corresponds to the bottle rim 136 when the pressure equalizer 3200 is associated with a bottle 100.

Referring now to FIG. 33, in at least one embodiment, the upper extent 3304 of the air tube 3208 terminates at the base 3300 of the perimeter air channel 3204. Alternatively, the upper extent 3304 of the air tube may be situated above the base 3300 of the perimeter air channel 3204, but below the upper rim 3228 of the perimeter air channel 3204.

As depicted in FIG. 32, a channel top 3220 of the perimeter air inlet channel 3204 may be open. Alternatively, at least portions of the channel top 3220 may be closed (not shown) while one or more other portions of the channel top are open.

Still referring to FIGS. 32 and 33, in use, regardless of the direction the bottle is oriented for pouring of the liquid relative to the one or more air inlet tubes 3208, air can enter the bottle via the perimeter air inlet channel 3204 and the one or more air tubes 3208 as fluid is poured from the bottle via exit channel 3224.

Referring now to FIGS. 34-37, in at least one embodiment, a pressure equalizer 3400 includes a plurality of air tubes 3208 fluidly interconnected to a perimeter air channel 3204, wherein the perimeter air channel 3204 may comprise one or more flow blocks 3404. More particularly, the pressure equalizer 3400 includes a plurality of air tubes 3208 that are interconnected to the perimeter air channel 3204 at its base 3300. The perimeter air channel 3204 includes flow blocks 3404 for preventing migration of liquid around the perimeter air channel 3204 when a bottle using the pressure equalizer 3400 is tipped for pouring a liquid from the bottle. At least one air tube of the plurality of air tubes 3208 is situated circumferentially between the flow blocks 3404 around the perimeter air channel 3204.

Figure 38:
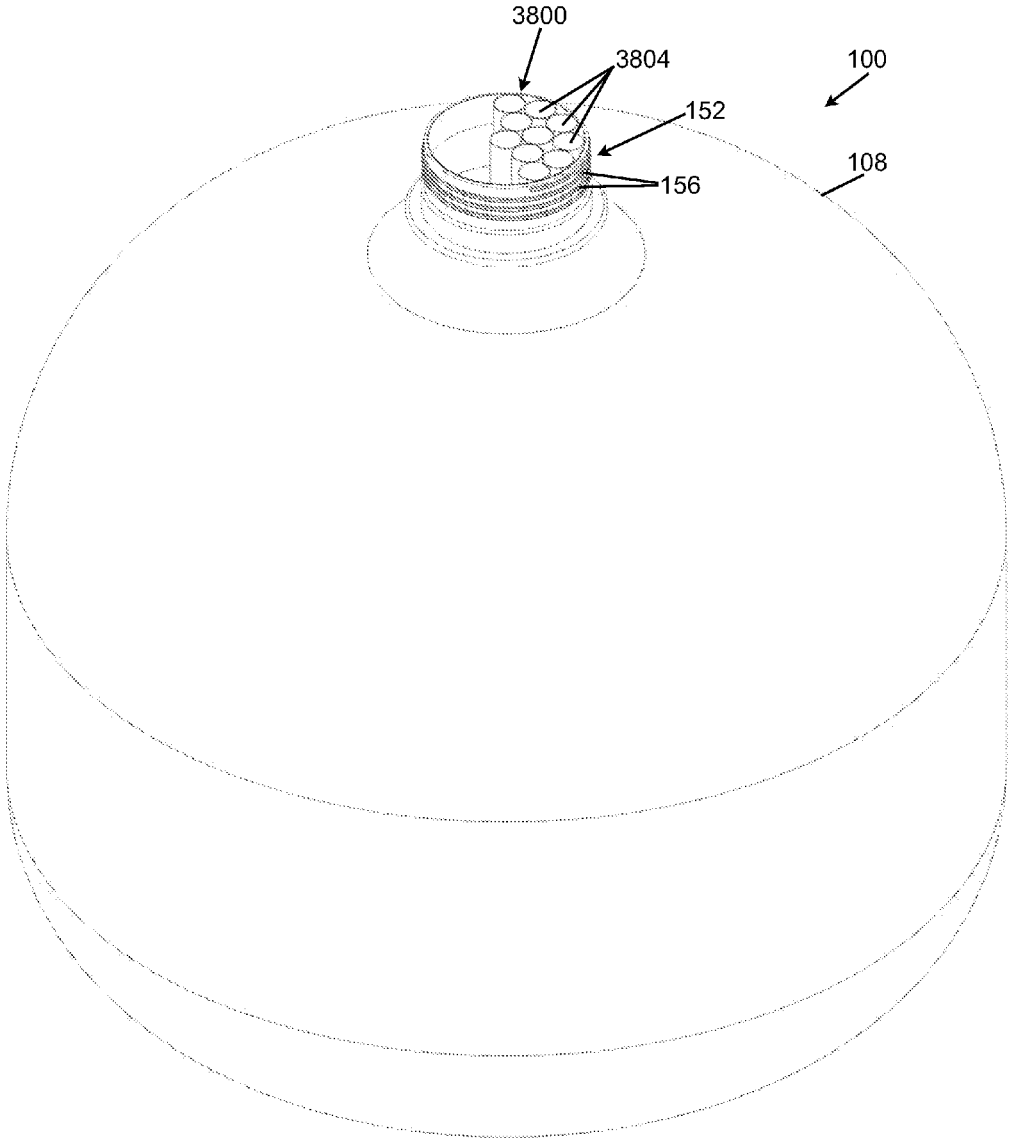
FIG. 38 is a side perspective view of an embodiment described herein.
Figure 39:
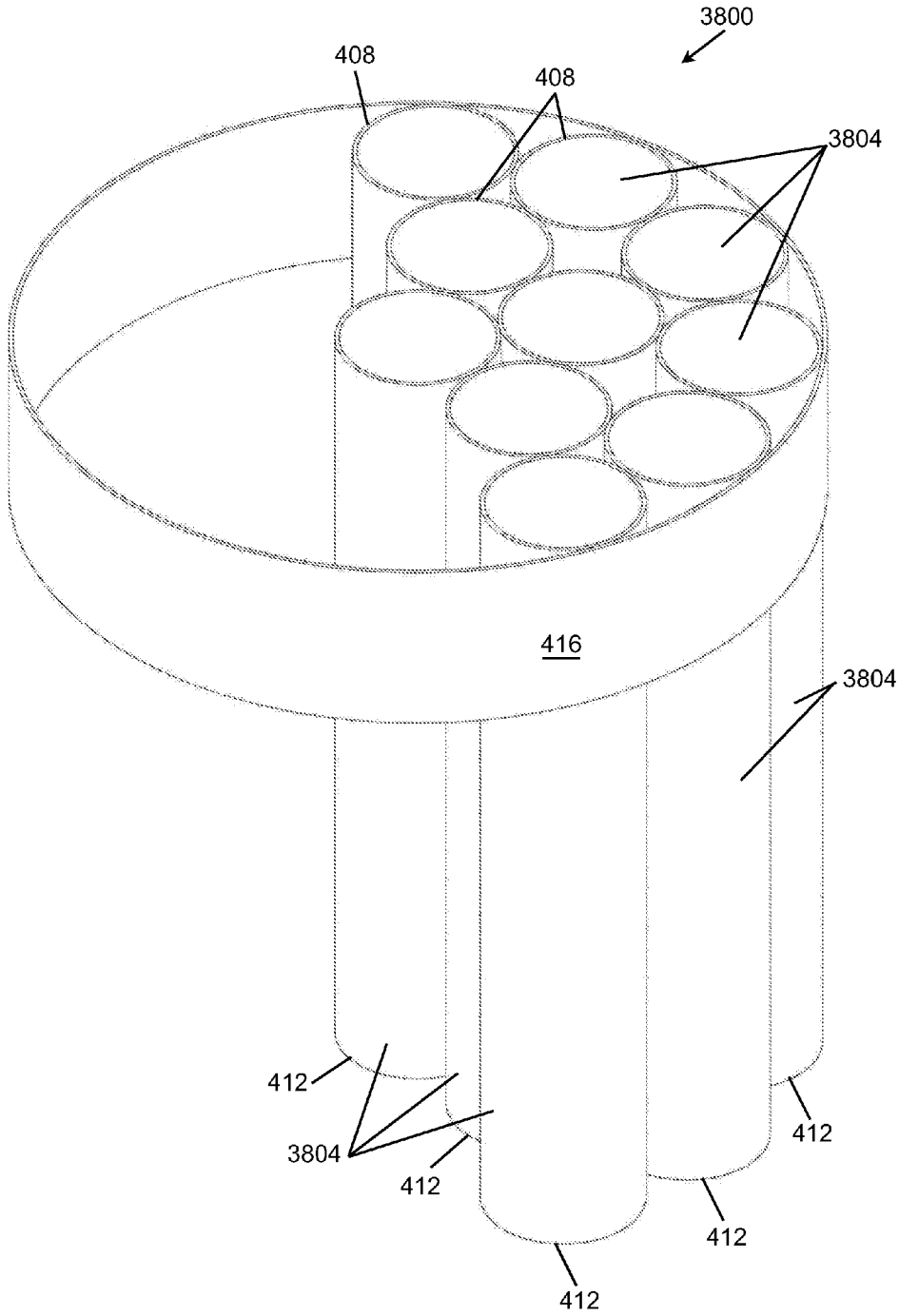
FIG. 39 is a top perspective view of an embodiment described herein.

Referring now to FIGS. 38 and 39, in at least one embodiment of the one or more present inventions, a pressure equalizer 3800 is shown that includes a plurality of air tubes 3804. Although not required, the air tubes are shown clustered within approximately one half of the bottleneck 152. The air tubes 3804 preferably have an air tube length $L_{Air\ Tube}$ within the prescribed values given above (that is, $L_{Bottleneck} \leq L_{Air\ Tube} \leq 25\%\ B_L$). In addition, each of the air tubes 3804 preferably has an air tube diameter $D_{Air\ Tube}$ of between about 2% to 50% of the bottleneck diameter $D_{Bottleneck}$. For the pressure equalizer 3800 shown in FIGS. 38 and 39, there are ten separate air tubes 3804 shown. However, it is to be understood that greater or fewer than ten separate air tubes 3804 are within the scope of the present embodiment. The air tubes 3804 may have uniform air tube diameters, or they may have differing air tube diameters. In addition, one or more of the air tubes 3804 may have flared portions. At least a portion of the upper inlet rim 408 of the air tubes 3804 is preferably situated within a rim proximity distance that is less than or equal to 5% of the bottleneck length $L_{Bottleneck}$.

Referring still to FIGS. 38 and 39, and as with other embodiments described and shown herein, when in use, air may enter the bottle 100 through one or more of the air tubes 3804. In addition, liquid may exit the bottle 100 through one or more of the air tubes 3804 as air enters other air tubes 3804. However, the existence of multiple air tubes 3804 facilitates separate flow paths for air to enter the bottle 100, thereby enabling air to find a path into the bottle 100 while the liquid exits the bottle 100.

With reference to FIG. 39, the pressure equalizer 3800 is depicted as an insert. Accordingly, for embodiments wherein the pressure equalizer 3800 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 3800 is integrally formed as part of the bottle 100, then the air tubes 3804 are positioned around a portion of the interior surface 128 of the bottleneck 152, and a number of the air tubes 3804 may be connected or interconnected to each other, particularly those air tubes 3804 residing within the inner interior portion of the bottleneck 152 and not situated directly adjacent the interior surface 128 of the bottleneck 152.

Figure 40:
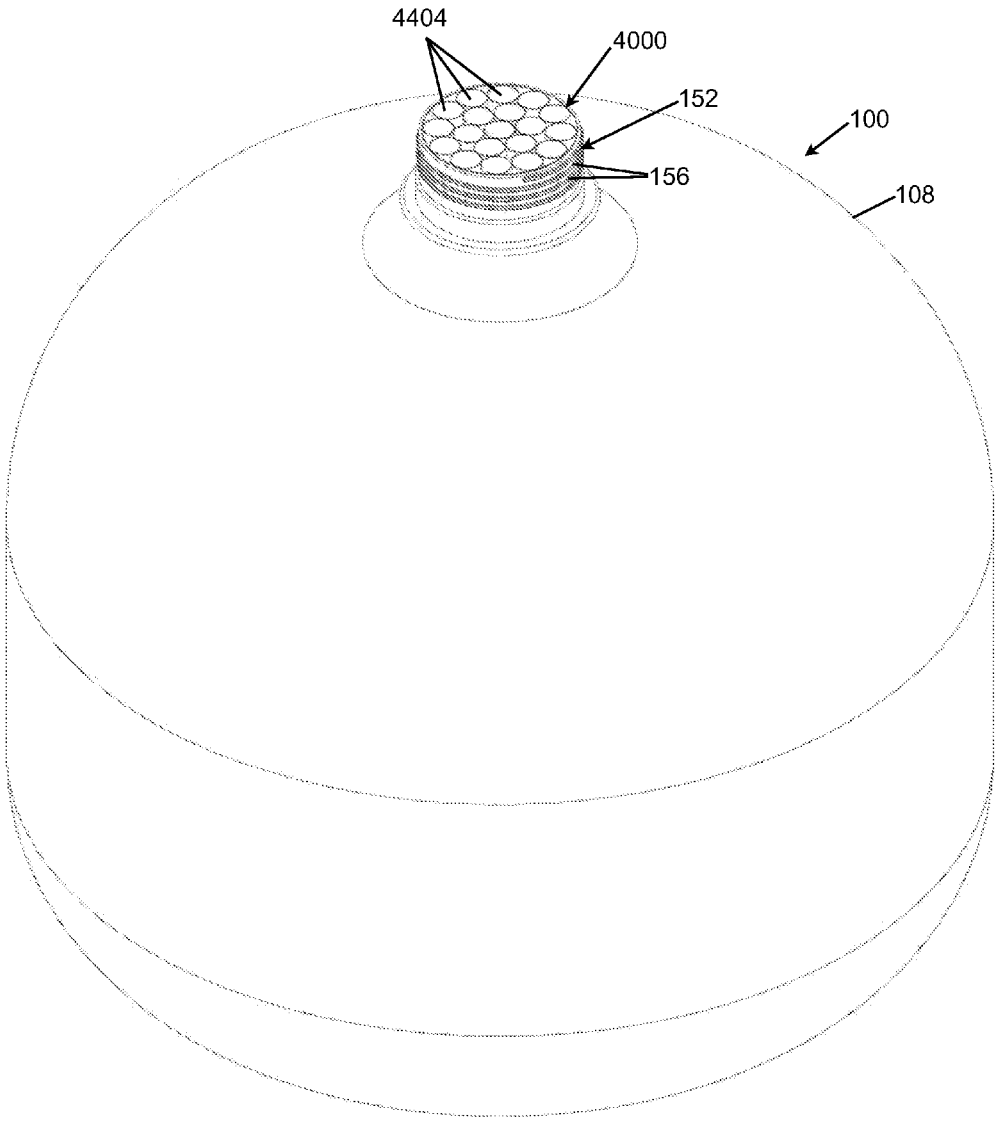
FIG. 40 is a side perspective view of an embodiment described herein.
Figure 41:
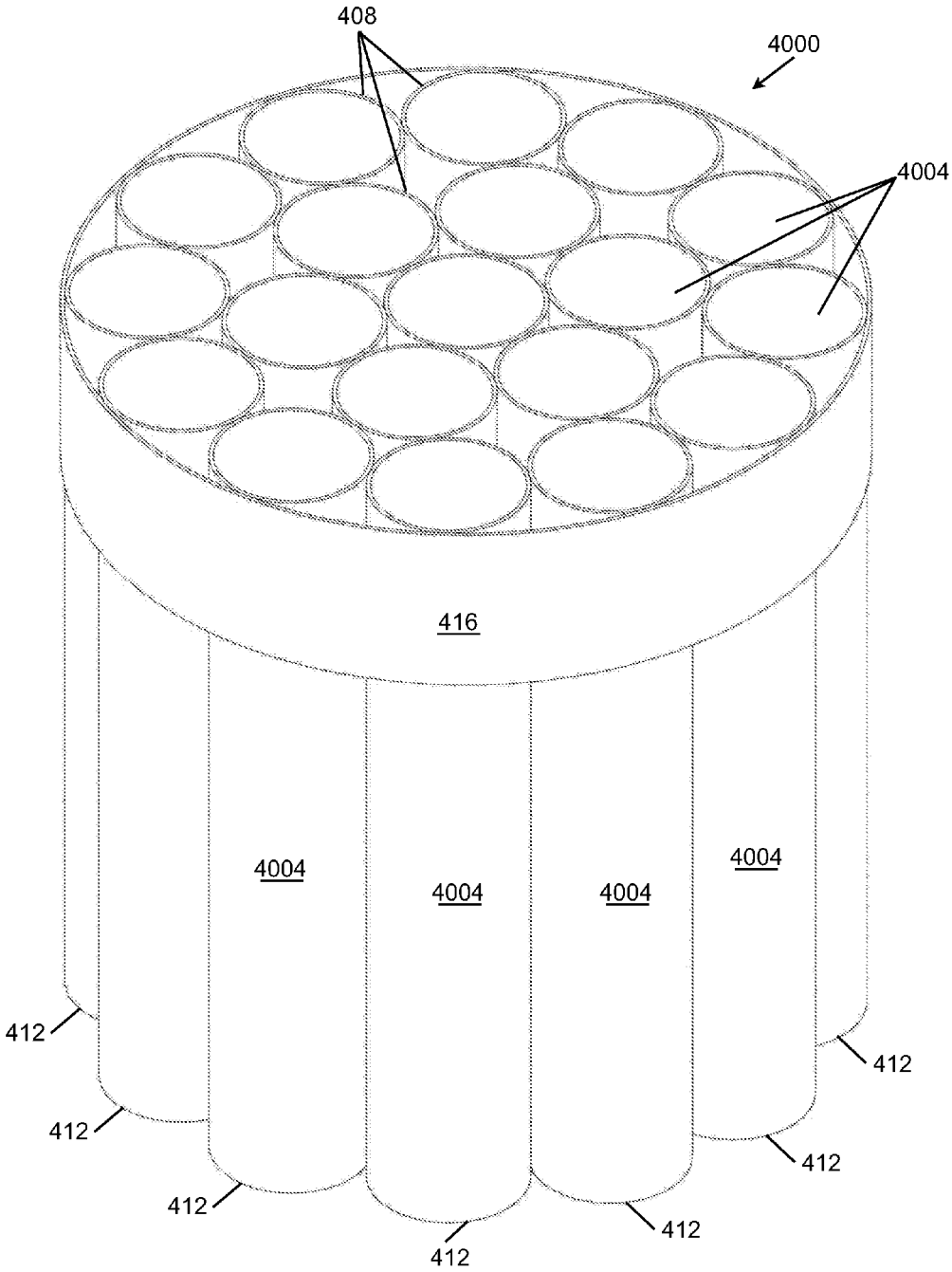
FIG. 41 is a top perspective view of an embodiment described herein.

Referring now to FIGS. 40 and 41, in at least one embodiment of the one or more present inventions, a pressure equalizer 4000 is shown that includes a plurality of air tubes 4004. The pressure equalizer 4000 has particular application to situations wherein a high volume and/or a high flow rate of liquid is anticipated. As can be seen, the plurality of air tubes 4004 occupies a significant portion of the bottleneck 152. The air tubes 4004 preferably have an air tube length $L_{Air\ Tube}$ within the prescribed values given above (that is, $L_{Bottleneck} \leq L_{Air\ Tube} \leq 25\%\ B_L$). In addition, each of the air tubes 4004 preferably has an air tube diameter $D_{Air\ Tube}$ of between about 2% to 50% of the bottleneck diameter $D_{Bottleneck}$. For the pressure equalizer 4000 shown in FIGS. 40 and 41, there are nineteen separate air tubes 4004 shown. However, it is to be understood that greater or fewer than nineteen separate air tubes 4004 are within the scope of the present embodiment. The air tubes 4004 may have uniform air tube diameters, or they may have differing air tube diameters. In addition, one or more of the air tubes 4004 may have flared portions.

With reference to FIG. 41, the pressure equalizer 4000 is depicted as an insert. Accordingly, for embodiments wherein the pressure equalizer 4000 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 4000 is integrally formed as part of the bottle 100, then the air tubes 4004 are positioned around a portion of the interior surface 128 of the bottleneck 152, and a number of the air tubes 4004 may be connected or interconnected to each other, particularly those air tubes 4004 residing within the inner interior portion of the bottleneck 152 and not situated directly adjacent the interior surface 128 of the bottleneck 152.

Referring still to FIGS. 40 and 41, and as with other embodiments described and shown herein, when in use, air may enter the bottle 100 through one or more of the air tubes 4004. In addition, liquid may exit the bottle 100 through one or more of the air tubes 4004 as air enters other air tubes 4004. However, the existence of multiple air tubes 4004 facilitates separate flow paths for air to enter the bottle, thereby enabling air to find a path into the bottle 100 while the liquid exits the bottle 100.

Referring now to FIGS. 42 and 43, in at least one embodiment of the one or more present inventions, a pressure equalizer 4200 is shown that includes a plurality of air tubes 4204 that resided within an air tube assembly 4208. As with pressure equalizer 4000, the pressure equalizer 4200 has particular application to situations wherein a high volume and/or a high flow rate of liquid is anticipated. As can be seen, the plurality of air tubes 4204 occupy a significant portion of the bottleneck 152. The air tubes 4204 preferably have an air tube length $L_{Air\ Tube}$ within the prescribed values given above (that is, $L_{Bottleneck} \leq L_{Air\ Tube} \leq 25\%\ B_L$). In addition, each of the air tubes 4204 preferably has an air tube diameter $D_{Air\ Tube}$ (or equivalent air tube diameter as described herein) of between about 2% to 50% of the bottleneck diameter $D_{Bottleneck}$. For the pressure equalizer 4200 shown in FIGS. 42 and 43, there are three concentric rings of air tubes with a further central air tube. The air tubes 4204 may have substantially uniform cross-sectional areas, or they may have differing cross-sectional areas with differing shapes. In addition, the air tubes 4204 residing within the air tube assembly 4208 may form a pattern or they may be randomly arranged. In addition, one or more of the air tubes 4204 may have flared portions.

With reference to FIG. 43, the pressure equalizer 4200 is depicted as an insert. Accordingly, for embodiments wherein the pressure equalizer 4200 is an insert, the perimeter member 416 is configured to fixedly engage (e.g., by friction fit, threads, welding, adhesive, and/or fastener) the interior surface 128 of the bottleneck 152 of the bottle 100. Alternatively, if the pressure equalizer 4200 is integrally formed as part of the bottle 100, then the air tubes 4204 are positioned around a portion of the interior surface 128 of the bottleneck 152, and a number of the air tubes 4204 may be connected or interconnected to each other, particularly those air tubes 4204 residing within the inner interior portion of the bottleneck 152 and not situated directly adjacent the interior surface 128 of the bottleneck 152. Sidewalls between the air tubes 4204 may be shared.

Referring still to FIGS. 42 and 43, and as with other embodiments described and shown herein, when in use, air may enter the bottle 100 through one or more of the air tubes 4204. In addition, liquid may exit the bottle 100 through one or more of the air tubes 4204 as air enters other air tubes 4204. However, the existence of multiple air tubes 4204 facilitates separate flow paths for air to enter the bottle, thereby enabling air to find a path into the bottle 100 while the liquid exits the bottle 100.

Figure 44:
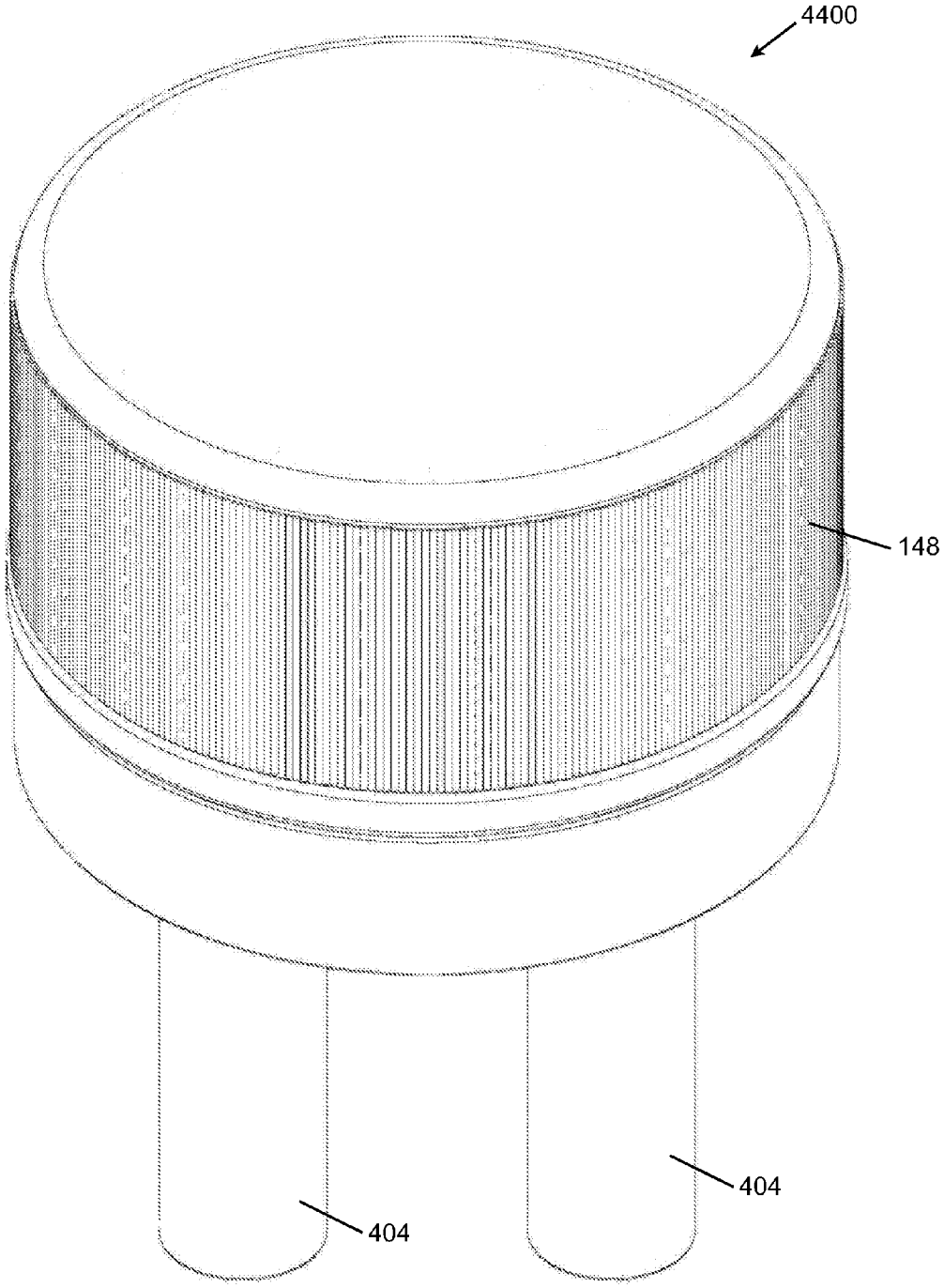
FIG. 44 is a top perspective view of an embodiment described herein.

Referring now to FIG. 44, and in accordance with at least one embodiment of the one or more present inventions, a carrier cap 4400 is shown that incorporates a cap 148 with a pressure equalizer, such as any one of the pressure equalizers described herein. By attaching a pressure equalizer to the inside of a bottle cap 148, a snap-capper or a rotary-chuck capping machine can install the pressure equalizer at the same time as the bottle is being capped, using the same machinery. Such a configuration provides time and cost savings for utilization of the pressure equalizers described herein. The pressure equalizer insert is attached to the cap in a similar way as the safety strip that is currently used to secure caps on bottles, such as two-liter beverage bottles. Accordingly, caps with pressure equalizer inserts are operatively associated with a bottle 100 when the caps 148 are applied with capping machines that insert the pressure equalizers with the caps 148 after filling the bottles 100. The bottle 100 is then ready for use by the consumer, and the previously installed pressure equalizer is in place for mitigating glugging when the liquid is poured from the bottle 100. Accordingly, in use, the pressure equalizer breaks free from the cap 148 when the consumer twists off the cap 148 for the first time in the same way that the consumer breaks the safety strip.

In at least one embodiment of the various pressure equalizers (400, 1100, 1300, 1500, 1704, 2000, 2200, 2400, 2600, 3000, 3200, 3400, 3800, 4000 and 4200) described herein, the top rim of the one or more air tubes associated with the pressure equalizer do not extend above the bottle rim 136 of the bottle 100. Advantageously, a cap associated with the bottle can be reused with the pressure equalizer in the bottle 100.

Air tubes described herein preferably include solid, non-perforated tubing walls. That is, there are no holes along the side walls of the air tubes between the upper inlet rims 408 and the lower end edges 412 of the air tubes. In at least one embodiment of all of the various pressure equalizers (400, 1100, 1300, 1500, 1704, 2000, 2200, 2400, 2600, 3000, 3200, 3400, 3800, 4000 and 4200) described herein, there are no holes along the side walls of the air tubes between the upper inlet rims 408 and the lower end edges 412 of the air tubes. In at least one embodiment of all of the various pressure equalizers (400, 1100, 1300, 1500, 1704, 2000, 2200, 2400, 2600, 3000, 3200, 3400, 3800, 4000 and 4200) described herein, and as someone of ordinary skill in the art would appreciate, if present, any holes within the sidewalls of the air tubes preferably do not materially impact the flow characteristics of the subject pressure equalizer.

In at least one embodiment of the various pressure equalizers (400, 1100, 1300, 1500, 1704, 2000, 2200, 2400, 2600, 3000, 3200, 3400, 3800, 4000 and 4200) described herein, the lower end edges 412 of the air tubes do not extend below about 25% of the bottle length $B_L$.

In at least one embodiment of the various pressure equalizers (400, 1100, 1300, 1500, 1704, 2000, 2200, 2400, 2600, 3000, 3200, 3400, 3800, 4000 and 4200) described herein, at least a portion of the upper inlet rim 408 of at least one air tube is situated within a rim proximity distance that is less than or equal to 5% of the bottleneck length $L_{Bottleneck}$.

In at least one embodiment of the various pressure equalizers (400, 1100, 1300, 1500, 1704, 2000, 2200, 2400, 2600, 3000, 3200, 3400, 3800, 4000 and 4200) described herein, even if having a non-circular cross-sectional shape, the air tubes preferably include a diameter or equivalent diameter (by measuring the cross-sectional area of the air tube and solving for an equivalent diameter) that resides within a range of about 2% to 50% of the bottleneck diameter $D_{Bottleneck}$. In addition, the air tube length $L_{Air\ Tube}$ of the air tubes is greater than or equal to the bottleneck length $L_{Bottleneck}$ and less than or equal to about 25% of the bottle length $B_L$(that is, $L_{Bottleneck} \leq L_{Air\ Tube} \leq 25\%\ B_L$).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The one or more present inventions, in various embodiments, include components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes (e.g., for improving performance, achieving ease and/or reducing cost of implementation).

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention (e.g., as may be within the skill and knowledge of those in the art, after understanding the present disclosure). It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A bottle insert for substantially equalizing atmospheric air pressure with air pressure within a bottle when pouring a liquid from the bottle, the bottle insert comprising:

a perimeter member adapted for contacting at least a portion of an interior bottleneck wall; and an air tube associated with the perimeter member, the air tube including an upper inlet rim and a lower end edge, the air tube including an air tube length $L_{Air\ Tube}$ extending between the upper inlet rim and the lower end edge, wherein the upper inlet rim is positioned even with a bottle opening rim, and wherein the lower end edge terminates in a transition section of a bottle located between a lower end of the bottleneck wall and an upper end of a sidewall of the bottle.

2. The bottle insert of claim 1, wherein the perimeter member engages the bottle by a friction fit.

3. The bottle insert of claim 1, wherein the air tube comprises a flared portion.

4. The bottle insert of claim 3, wherein the flared portion includes a flared portion base that does not extend distally beyond the bottleneck base.

5. The bottle insert of claim 1, further comprising at least one additional air tube.

6. The bottle insert of claim 5, wherein the at least one additional air tube includes a length equal to the air tube length $L_{Air\ Tube}$.

7. The bottle insert of claim 1, wherein the transition section of the bottle in which the lower end edge terminates comprises a diameter that is greater than a bottleneck diameter and less than a maximum bottle diameter.

8. A liquid containment and delivery device, comprising:

(a) a bottle having a bottle length $B_L$, the bottle including a bottleneck and a bottle opening having an opening diameter, the bottleneck having an interior bottleneck wall, a bottleneck diameter $D_{Bottleneck}$ and a bottleneck length $L_{Bottleneck}$ extending between a bottle opening rim at the bottle opening to a bottleneck base at a top of a bottle taper of the bottle, the bottle opening rim circumscribing the bottle opening; and (b) a pressure reliever comprising an air tube attached to the interior bottleneck wall, the air tube including an upper inlet rim and a lower end edge, the air tube including an air tube length $L_{Air\ Tube}$ extending between the upper inlet rim of the air tube and the lower end edge of the air tube, wherein the upper inlet rim is positioned even with the bottle opening rim, and wherein the lower end edge is positioned within the bottle taper of the bottle.

9. The liquid containment and delivery device of claim 8, wherein the air tube comprises a flared portion.

10. The liquid containment and delivery device of claim 9, wherein the flared portion includes a flared portion base that does not extend distally beyond the bottleneck base.

11. The liquid containment and delivery device of claim 8, further comprising at least one additional air tube.

12. The liquid containment and delivery device of claim 11, wherein the at least one additional air tube includes a length equal to the air tube length $L_{Air\ Tube}$.

13. The liquid containment and delivery device of claim 8, wherein the bottle taper comprises a section of the bottle from where the bottle diameter is greater than the bottleneck diameter $D_{Bottleneck}$ to a maximum bottle diameter and wherein the lower end edge does not extend beyond the bottle taper so as to be even with the bottle at a location of the maximum bottle diameter.

* * * * *